US007884840B2

(12) United States Patent
Sohmiya et al.

(10) Patent No.: US 7,884,840 B2
(45) Date of Patent: Feb. 8, 2011

(54) IMAGE FORMING METHOD AND APPARATUS FOR TRANSFER AND FIXING IMAGE WITH ONE PROCESS

(75) Inventors: Norimasa Sohmiya, Soka (JP); Chiemi Kaneko, Tokyo (JP); Hirokatsu Suzuki, Zama (JP); Kenichi Taguma, Sagamihara (JP); Emiko Ishikawa, Sagamihara (JP); Yasukuni Omata, Chigasaki (JP)

(73) Assignee: Ricoh Co., Ltd., Tokyo (JP)

( * ) Notice: Subject to any disclaimer, the term of this patent is extended or adjusted under 35 U.S.C. 154(b) by 1240 days.

(21) Appl. No.: 11/487,349

(22) Filed: Jul. 17, 2006

(65) Prior Publication Data

US 2007/0014596 A1 Jan. 18, 2007

(30) Foreign Application Priority Data

Jul. 15, 2005 (JP) ..... 2005-207866

(51) Int. Cl.
*B41J 2/315* (2006.01)

(52) U.S. Cl. ..... 347/171

(58) Field of Classification Search ..... 347/171, 347/172–173, 175–176, 213, 215, 218; 400/120.01, 400/120.02, 120.04, 120.16; 399/119, 307
See application file for complete search history.

(56) References Cited

FOREIGN PATENT DOCUMENTS

| | | |
|---|---|---|
| JP | 10-142869 | 5/1998 |
| JP | 2004-191554 | 7/2004 |

OTHER PUBLICATIONS

U.S. Appl. No. 11/940,033, filed Nov. 14, 2007, Enoki, et al.
U.S. Appl. No. 11/773,215, filed Jul. 3, 2007, Suzuki.
U.S. Appl. No. 11/751,223, filed May 21, 2007, Shiraishi, et al.

*Primary Examiner*—K. Feggins
(74) *Attorney, Agent, or Firm*—Oblon, Spivak, McClelland, Maier & Neustadt, L.L.P.

(57) ABSTRACT

An image forming method and apparatus includes a first image carrying member, a first transfix unit, a second image carrying member, and a second transfix unit. The first image carrying member carries a first toner image thereon. The first transfix unit receives the first toner image from the first image carrying member and transfers and fixes the first toner image onto a first face of a recording sheet with a heat effect. The second image carrying member carries a second toner image thereon. The second transfix unit receives the second toner image from the second image carrying member and transfers and fixes the second toner image onto a second face of the recording sheet with a heat effect.

8 Claims, 6 Drawing Sheets

IMAGE FORMING METHOD AND APPARATUS FOR TRANSFER AND FIXING IMAGE WITH ONE PROCESS

TECHNICAL FIELD

The present disclosure generally relates to an image forming apparatus, and more particularly to an image forming apparatus for transferring and fixing an image with one process.

BACKGROUND

In general, an image forming apparatus can use methods such as switch-back system and one-path system to produce images on both faces of a recording medium such as transfer sheet.

In case of the switch-back system, the recording medium is passed through a transfer unit and then a fixing unit to record an image on one face of the recording medium, and then the recording medium is transported to a sheet inverting route to invert faces of the recording medium. Then, the recording medium is switchbacked to the transfer unit and the fixing unit to record an image on the other face of the recording medium.

In case of the one-path system, a double-side transfer mechanism transfers images to both faces of the recording medium and then the recording medium is passed through a fixing unit. Therefore, images can be recorded on both faces of the recording medium without switchbacking the recording medium.

Accordingly, the one-path system can avoid the following aspects associated to the switch-back system; a cost increase due to providing a switchback mechanism; a longer time period for image forming due to switchback process; a sheet jamming which might occur by switchbacking the recording medium curled by heating of a fixing unit, for example.

However, in the one-path system, a disturbance may likely to occur on images when transporting a recording medium from the double-side transfer mechanism to the fixing unit.

In general, a sheet transporting unit is provided between the double-side transfer mechanism and fixing unit in an image forming apparatus employing the one-path system to transport the recording medium having unfixed images on its both faces.

When such recording medium is transported from the double-side transfer mechanism to the fixing unit in the one-path system, the recording medium may be scratched by components of the sheet transporting unit because one face of the recording medium having an un-fixed toner image contacts such component.

With such scratching, the un-fixed toner image on the recording medium may be disturbed.

If a toner image is transferred only to one face of the recording medium (e.g., transfer sheet), a disturbance of the un-fixed toner image can be prevented by contacting a face of the recording medium having no toner image to the component of the sheet transporting unit. Such a configuration can be designed by modifying a design layout in an image forming apparatus.

However, if toner images are transferred to both faces of the recording medium (e.g., transfer sheet), one face of the recording medium having toner image contacts the component of the sheet transporting unit, thereby a disturbance of the images may occur when transporting the recording medium from the double-side transfer mechanism to the fixing unit.

In one related art, a spur, having a plurality of projections on its peripheral circumference, is provided between a double-side transfer mechanism and a fixing unit in an image forming apparatus, wherein the double-side transfer mechanism can transfer toner images to both faces a recording medium (e.g., transfer sheet), and the spur can be rotated by a driving unit.

With such configuration, the recording medium (e.g., transfer sheet) can be guided (i.e., transported) from the double-side transfer mechanism to the fixing unit in the image forming apparatus.

The spur can support the recording medium by sticking the projections from an underside portion of the recording medium.

With rotation of the spur, the recording medium can be guided (i.e., transported) from the double-side transfer mechanism to the fixing unit while the recording medium is supported by the spur from a underside face of the recording medium.

However, the spur has projections that stick the recording medium, by which un-fixed toner images on the recording medium may be disturbed even if the projections of the spur has a sharp profile.

In another related art device, an image forming apparatus includes a first image forming unit and second image forming unit to produce an image on a recording medium with one-path system.

A first toner image formed in the first image forming unit is transferred to a first intermediate transfer belt serving as image carrying belt, and the first toner image is transferred from the first intermediate transfer belt to a first heatable transfer member.

The first toner image, transferred on the first heatable transfer member, is softened (or melted) by heating the first toner image on the first heatable transfer member before the first toner image is transported to a transfer and fixing nip. Then, the first toner image is transferred and fixed on a first face of the transfer sheet.

Similarly, a second toner image, formed in the second image forming unit, is transferred from a second intermediate transfer belt, serving as image carrying belt, to a second heatable transfer member. The second toner image is similarly softened (or melted) on the second heatable transfer member, and is transferred and fixed on a second face of the transfer sheet.

With such configuration, two images are simultaneously transferred and fixed on each face of the transfer sheet, and thereby the transfer sheet having an unfixed toner image on its both face may not be required to be transported to a fixing unit. Accordingly, an image disturbance caused by a transportation of transfer sheet having unfixed toner image on its face can be prevented.

In such image forming apparatus, a toner image may be transferred from the intermediate transfer belt to the heatable transfer member with an electrostatic transfer method, and a cooling unit is provided to cool the heatable transfer member after the toner image is transferred and fixed on the transfer sheet so that excessive heat may not be conveyed to the intermediate transfer belt from the heatable transfer member.

The electrostatic transfer method may cause dust generation or bleeding of the image with an effect of electric discharge or electric field at an entrance and exit of a transfer nip, by which an image quality may degrade.

Furthermore, the electrostatic transfer method needs a bias voltage charger for conducting electrostatic transfer, by which a manufacturing cost of an image forming apparatus may increase.

Furthermore, if the heatable transfer member is cooled after transferring and fixing a toner image on the transfer sheet, the amount of heat to soften (or melt) the toner image on the heatable transfer member may be unfavorably increased, by which energy consumption in the image forming apparatus may increase.

SUMMARY

The present disclosure relates to an image forming apparatus including a first image carrying member, a first transfix unit, a second image carrying member, and a second transfix unit. The first image carrying member carries a first toner image thereon. The first transfix unit includes a first heatable member, and a first heater. The first heatable member, heated by the first heater, receives the first toner image from the first image carrying member and transfers and fixes the first toner image onto a first face of a recording sheet with a heat generated on the first heatable member. The second image carrying member carries a second toner image thereon. The second transfix unit includes a second heatable member, and a second heater. The second heatable member, heated by the second heater, receives the second toner image from the second image carrying member and transfers and fixes the second toner image onto a second face of the recording sheet with a heat generated on the second heatable member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF THE PREFERRED EMBODIMENTS

Figure 1:
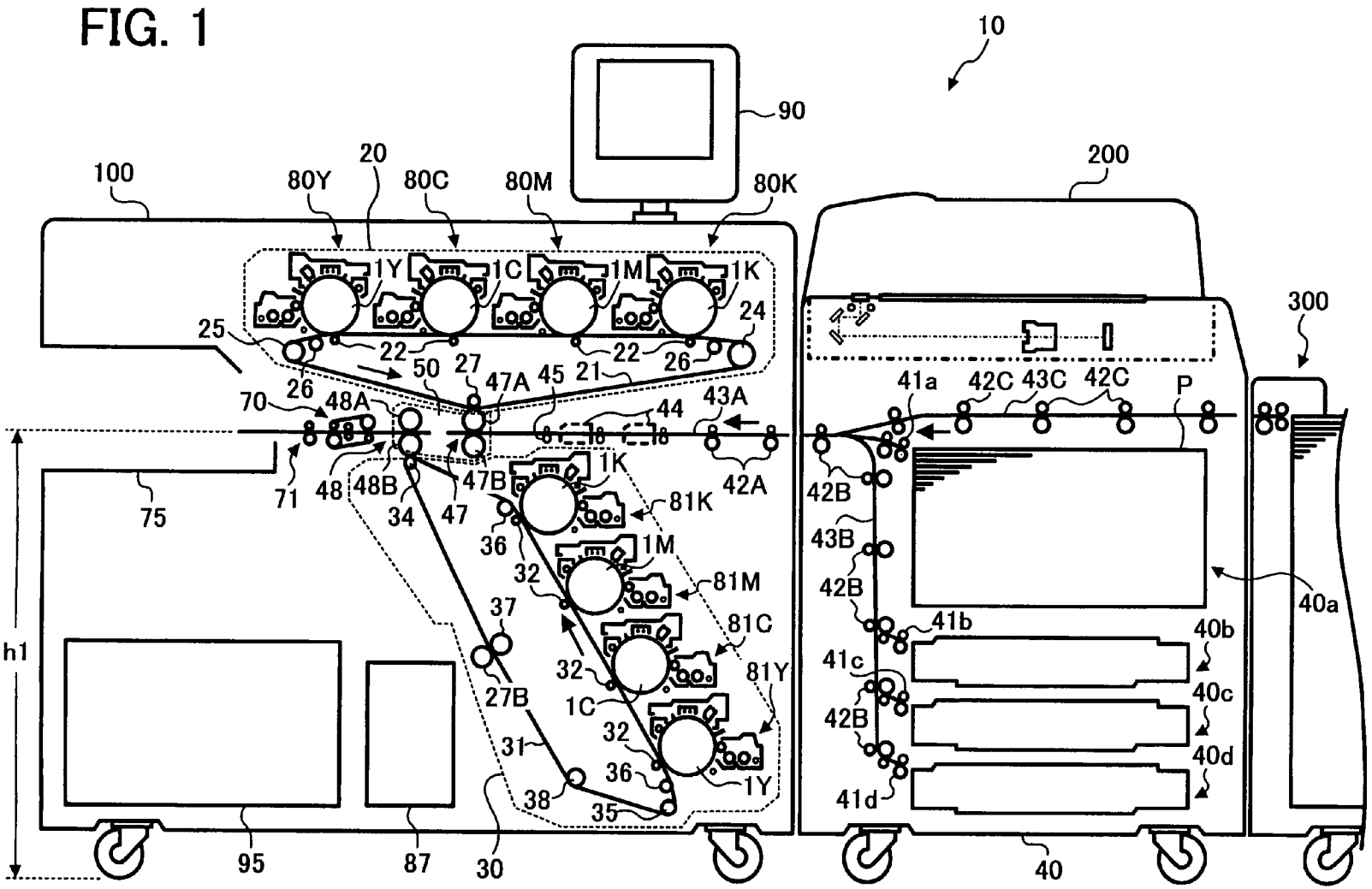
FIG. 1 is a schematic configuration of an image forming apparatus according to an example embodiment.

In describing the exemplary embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to a first exemplary embodiment is described with reference to FIG. 1.

FIG. 1 is a schematic configuration of an image forming apparatus 10 according to the first embodiment, wherein the image forming apparatus 10 can be used as color image forming apparatus using electro photography, for example.

The image forming apparatus 10 includes a printing unit 100, an operation/display unit 90, a sheet feed unit 40, an automatic document feeder 200, and an annex sheet feed unit 300 as illustrated in FIG. 1.

The printing unit 100 includes a first image forming section 20, a second image forming section 30, a sheet feed route 43A, and a controller 95 as illustrated in FIG. 1.

The first image forming section 20 is disposed over the sheet feed route 43A, and the second image forming section 30 is disposed under the sheet feed route 43A.

The first image forming section 20 includes a first intermediate transfer belt 21 configured to be traveled in a direction shown by an arrow in FIG. 1. The first intermediate transfer belt 21 includes an endless type belt as illustrated in FIG. 1.

The second image forming section 30 includes a second intermediate transfer belt 31 configured to travel in the direction shown by an arrow in FIG. 1. The second intermediate transfer belt 31 includes an endless type belt as illustrated in FIG. 1.

As illustrated in FIG. 1, first process units 80Y, 80M, 80C, and 80K are disposed above the first intermediate transfer belt 21, wherein the first process units 80Y, 80M, 80C, and 80K are used for toner image forming.

As also illustrated in FIG. 1, second process units 81Y, 81M, 81C, and 81K are disposed to a side portion of the second intermediate transfer belt 31, wherein the second process units 81Y, 81M, 81C, and 81K are used for toner image forming.

Hereinafter, reference characters "Y, M, C, and K" indicate color of "yellow, magenta, cyan, and black," respectively.

Each of the process units (i.e., 80Y, 80M, 80C, 80K, 81Y, 81M, 81C, 81K) includes a photosensitive member (i.e., 1Y, 1M, 1C, 1K) serving as image carrying member.

The first process units 80Y, 80M, 80C, and 80K include the photosensitive members 1Y, 1M, 1C, and 1K, respectively, wherein the photosensitive members 1Y, 1M, 1C, and 1K are arranged with an equal interval, and can contact an outer surface of the first intermediate transfer belt 21 when conducting image forming.

Hereinafter, such outer surface of the first intermediate transfer belt 21 is referred as first image receiving belt-surface.

The second process units 81Y, 81M, 81C, and 81K include the photosensitive members 1Y, 1M, 1C, and 1K, respectively, wherein the photosensitive members 1Y, 1M, 1C, and 1K are arranged with an equal interval, and can be contacted to an outer surface of the second intermediate transfer belt 31 when conducting an image forming.

Hereinafter, such outer surface of the second intermediate transfer belt 31 is referred as second image receiving belt-surface.

As illustrated in FIG. 1, the first intermediate transfer belt 21 is extended by a plurality of rollers in a substantially horizontal direction, whereby the first image receiving belt-surface substantially extends in a horizontal direction as illustrated in FIG. 1. Accordingly, the first intermediate transfer belt 21 occupy a space in the printing unit 100 in a horizontal direction.

The first process units 80Y, 80M, 80C, and 80K are arranged in a tandem manner above the first image receiving belt-surface of the first intermediate transfer belt 21 as illustrated in FIG. 1.

On the one hand, the second intermediate transfer belt 31 is extended by a plurality of rollers, wherein the second intermediate transfer belt 31 is extended from a bottom right to an upper left as illustrated in FIG. 1.

As illustrated in FIG. 1, a right side portion of the second intermediate transfer belt 31 extends in a downward direction.

The second process units 81Y, 81M, 81C, and 81K are arranged in a tandem manner along the right side portion (i.e., second image receiving belt-surface) of the second intermediate transfer belt 31, whereby the second process units 81Y, 81M, 81C, and 81K are arranged in a step-wise manner in a substantially vertical direction as illustrated in FIG. 1.

Figure 2:
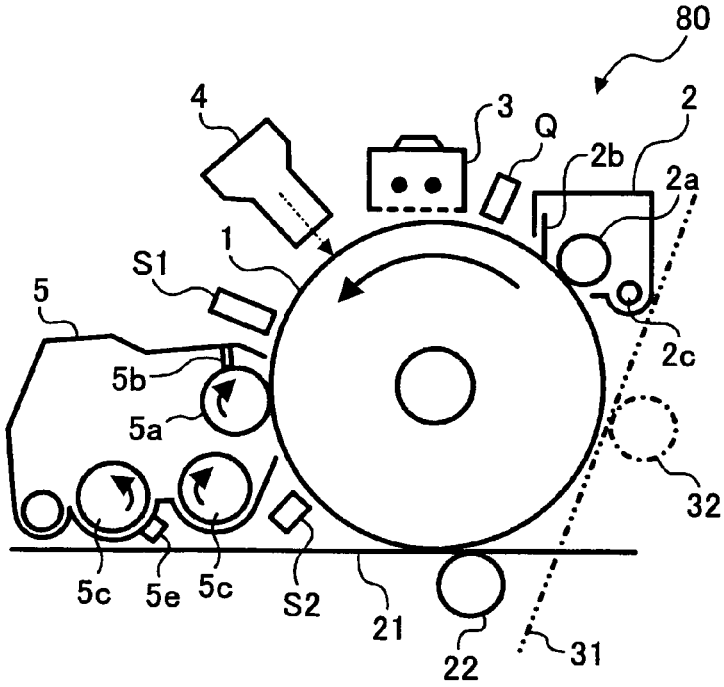
FIG. 2 is a schematic expanded view of a first process unit in a printing unit of an image forming apparatus in FIG. 1.

FIG. 2 is a schematic expanded view of a process unit of the first process units 80Y, 80M, 80C, and 80K in the printing unit 100 of the image forming apparatus 10.

Because the first process units 80Y, 80M, 80C, and 80K have a similar configuration to one another except the color type of toner, reference characters "Y, M, C, and K" are omitted from the drawing in FIG. 2.

As illustrated in FIG. 2, the photosensitive member 1 is driven in a counter-clockwise direction by a drive unit (not shown) when the printing unit 100 is operated for image forming.

As illustrated in FIG. 2, the photosensitive member 1 is surrounded by a scorotron charger 3, an optical writing unit 4, a developing unit 5, a cleaning unit 2, a de-charging unit Q, an electric potential sensor S1, and an image sensor S2, for example.

The photosensitive member 1 can be formed in a drum shape. For example, the photosensitive member 1 can be made of an aluminum cylinder having a diameter of 30 mm to 120 mm, and a photoconductive material such as organic photo conductor (OPC) and amorphous silicon (a-Si) is coated on the cylinder.

Although not shown, the photosensitive member 1 can also be formed in a belt shape.

As illustrated in FIG. 2, the cleaning unit 2 includes a cleaning brush 2*a*, a cleaning blade 2*b*, and a collector 2*c*.

The cleaning unit 2 removes and collects toners remaining on the photosensitive member 1 after a toner image is transferred to the first intermediate transfer belt 21 from the photosensitive member 1 at a primary transfer nip, to be described later.

The scorotron charger 3 uniformly charges a surface of the photosensitive member 1 to a negative potential, for example.

Instead of the scorotron charger 3, a corotron charger can be used to uniformly charge a surface of the photosensitive member 1. Furthermore, instead of the scorotron charger 3, a charge biasing member (not shown) applied with a charge bias can be contacted to the surface of the photosensitive member 1, for example.

The optical writing unit 4 scans the charged surface of the photosensitive member 1 with a light beam, generated based on image data for each color, to form an electrostatic latent image on the surface of the photosensitive member 1.

The optical writing unit 4 includes a LED (light emitting diode) array and a focusing element, for example. The optical writing unit 4 can also includes a laser type unit, which includes a laser beam source, a polygon mirror and other components to generate a modulated laser beam based on image data.

The developing unit 5 includes a developing roller 5*a*, a blade 5*b*, transport screws 5*c*, and a toner concentration sensor 5*e*.

The developing unit 5 also includes a two-component developer having toners and magnetic carriers to develop the electrostatic latent image formed on the photosensitive member 1.

The two-component developer is agitated and transported in a given direction by two transport screws 5*c* in the developing unit 5. Each of the transport screws 5*c* transports the developer in opposite directions each other in the developing unit 5.

For example, if the transport screw 5*c* shown in a left side portion in FIG. 2 transports the developer in one direction, the transport screw 5*c* in the right side portion in FIG. 2 transports the developer in another direction opposite that of the transport screw 5*c* in a left side portion in FIG. 2.

The two-component developer, agitated and transported by the transport screw 5*c* in a left side portion in FIG. 2, is then transported to the transport screw 5*c* in a right side portion in FIG. 2.

During agitation and transportation of the two-component developer by the transport screw 5*c* in a right side in FIG. 2, some two-component developer is carried onto the developing roller 5*a*.

The two-component developer not carried onto the developing roller 5*a* is transported to the transport screw 5*c* in a left side in FIG. 2.

As such, the two-component developer is re-circulated in the developing unit 5.

Furthermore, the developing unit 5 can include one-component developer having toners without magnetic carriers.

The developing roller 5*a* includes a sleeve, and a magnet roller. The sleeve can be made of non-magnetic material such as stainless steel and aluminum and is driven by a drive unit (not shown) in a clockwise direction as shown in FIG. 2.

Although the magnet roller is encased in the sleeve, the magnet roller does not rotate with the sleeve. The magnet roller includes a plurality of magnets provided on a circumference of the magnet roller.

The two-component developer transported by the transport screw 5*c* in a right side of FIG. 2 is attracted by the magnetic field of the magnet roller, and carried onto the sleeve.

Then, the two-component developer on the sleeve comes to a regulating position defined by the blade 5*b* before transported to a developing area facing the photosensitive member 1.

The blade 5*b* faces the sleeve with a given gap therebetween by positioning an edge of the blade 5*b* at a given position from the sleeve.

When the two-component developer on the sleeve passes the edge of the blade 5*b*, the blade 5*b* regulates a layer thickness of the two-component developer on the sleeve to a given level.

Then, the two-component developer having the regulated layer thickness is transported to the developing area facing the photosensitive member 1 with a rotation of the sleeve.

In the developing area, the electrostatic latent image formed on the photosensitive member 1 is developed as toner image with an adhesion of toners of the two-component developer.

With such process, each toner image of Y, M, C, and K is formed on the photosensitive member 1.

The toner includes a spherical toner and non-spherical toner, which can be made by a known method. In general, toner having a volume average particle diameter of 20 μm or less may be used. For example, toner having a volume average particle diameter from 4 to 10 μm may be used.

The magnetic carrier can be made by a known method. The magnetic carrier preferably has a volume average particle diameter of 25 to 60 μm, for example.

The two-component developer, which released the toner at the developing area, returns to the developing unit 5 with a rotation of the sleeve.

With an effect of magnetic field by magnets on the magnet roller, the two-component developer is dropped from the sleeve and returned to the transport screw 5*c* in a right side portion of FIG. 2, and then moved to the transport screw 5*c* in a left side of FIG. 2.

As illustrated in FIG. 2, the toner concentration sensor 5*e* is provided under the transport screw 5*c* in a left side portion of FIG. 2 to detect the magnetic permeability of the two-component developer transported by the transport screw 5*c* in a left side of FIG. 2.

The magnetic permeability of the two-component developer correlates to toner concentration, whereby the toner concentration sensor 5*e* detects the toner concentration in the developing unit 5.

If the controller 95 judges that the toner concentration in the two-component developer is below a given threshold value based on an output signal of the toner concentration sensor 5*e*, one of eight toner supply units (not shown), is activated for a given time to supply fresh toners to the developing unit 5.

Each of the eight toner supply units (not shown) corresponds to the developing unit 5 in the first process units 80Y, 80M, 80C, and 80K or developing unit 5 in the second process units 81Y, 81M, 81C, and 81K.

Each of the eight toner supply units (not shown) can be connected one of corresponding toner bottles (not shown), wherein the toner bottles (not shown) can be detachably provided on a top of the printing unit 100.

Each toner of Y, M, C, and K, supplied to the corresponding developing unit 5 from the toner bottles (not shown), is refilled onto the transport screw 5*c* in a left side of FIG. 2.

With such process, toners can be refilled to the two-component developer in the developing unit 5, whereby a toner concentration in the developing unit 5 can be maintained at a given level.

As for the toner supply unit (not shown), a publicly-known mohno-pump is preferably used to suck toners from the toner bottles (not shown) and to transport toners to the developing unit 5.

Because such configuration has less restriction on designing a place to set the toner bottles (not shown), it is preferable from the viewpoint of space allocation in the printing unit 100.

Furthermore, because such configuration can supply toners to the developing unit 5 as required, the developing unit 5 does not require a large space for storing toners. Thereby, the developing unit 5 can be miniaturized.

Figure 3:
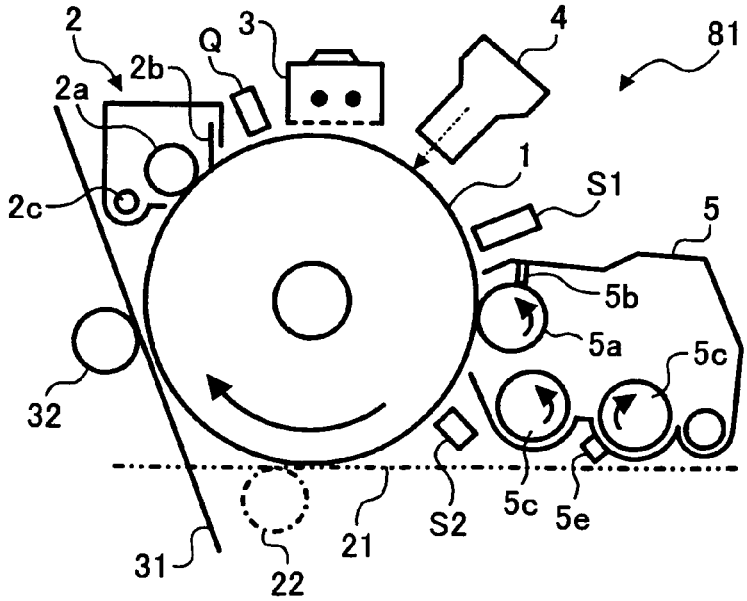
FIG. 3 is a schematic expanded view of a second process unit in a printing unit of an image forming apparatus in FIG. 1.

FIG. 3 is a schematic expanded view of a process unit of second process units 81Y, 81M, 81C, and 81K in the printing unit 100 of the image forming apparatus 10.

The second process units 81Y, 81M, 81C, and 81K have a similar configuration to one another except for the color type of toner.

Furthermore, the second process units 81Y, 81M, 81C, and 81K and the first process units 80Y, 80M, 80C, and 80K have a similar configuration to one another except for the rotational direction of the photosensitive member 1, wherein the photosensitive member 1 in the second process units 81Y, 81M, 81C, and 81K rotate in an opposite direction as compared to the photosensitive member 1 in the first process units 80Y, 80M, 80C, and 80K.

The first process units 80Y, 80M, 80C, and 80K and the second process units 81Y, 81M, 81C, and 81K have a symmetrical configuration to each other as illustrated in FIGS. 2 and 3. Such symmetrical configuration has preferable aspects as below.

For example, such symmetrical configuration is preferable by considering a design layout for connecting the process unit 80 and 81 with other units in the printing unit 100 such as a drive unit, an electrical unit, a toner supply unit, and a toner ejection unit.

Furthermore, the first process units 80Y, 80M, 80C, and 80K and the second process units 81Y, 81M, 81C, and 81K can be made as interchangeable units because of such symmetrical configuration.

Accordingly, the first process units 80Y, 80M, 80C, and 80K and the second process units 81Y, 81M, 81C, and 81K can use common parts for the developing unit 5, cleaning unit 2 and other units, thereby unique parts are not required for each of the first process units 80Y, 80M, 80C, and 80K and the second process units 81Y, 81M, 81C, and 81K. Therefore, a manufacturer can streamline parts management and the manufacturing works, by which the overall manufacturing cost of an image forming apparatus can be reduced.

As illustrated in FIG. 1, the printing unit 100 includes the first image forming section 20 and the second image forming section 30.

In the first image forming section 20, the first intermediate transfer belt 21 is extended by a plurality of rollers 22, 24, 25, 26, and 27.

The first intermediate transfer belt 21 can contact the photosensitive members 1Y, 1M, 1C, and 1K of the respective first process units 80Y, 80M, 80C, and 80K.

Such contact point of the first intermediate transfer belt 21 and the photosensitive members 1Y, 1M, 1C, and 1K is defined as a primary transfer nip formed between the first intermediate transfer belt 21 and the photosensitive members 1Y, 1M, 1C, and 1K.

At such primary transfer nip, Y, M, C, and K toner image on the respective photosensitive members 1Y, 1M, 1C, and 1K are super-imposingly transferred to the first intermediate transfer belt 21.

The first intermediate transfer belt 21 of endless type belt travels in a clockwise direction as shown by an arrow in FIG. 1.

At each primary transfer nip, a primary transfer roller 22 and the photosensitive members 1Y, 1M, 1C, and 1K sandwich the first intermediate transfer belt 21, wherein the primary transfer roller 22 is applied with a primary transfer bias voltage by a power source (not shown).

With the effect of the primary transfer bias voltage and nip pressure, Y, M, C, and K toner image on the respective photosensitive members 1Y, 1M, 1C, and 1K are super-imposingly transferred to the first intermediate transfer belt 21 at each primary transfer nip.

The first intermediate transfer belt 21 and relating parts are integrated in the first image forming section 20, thereby the first image forming section 20 is detachable from the printing unit 100 as one unit.

On the one hand, in the second image forming section 30, the second intermediate transfer belt 31 is extended by a plurality of rollers 32, 34, 35, 36, 37, and 38.

The second intermediate transfer belt 31 can contact the photosensitive members 1Y, 1M, 1C, and 1K of the respective second process units 81Y, 81M, 81C, and 81K.

Such contact point of the second intermediate transfer belt 31 and the photosensitive members 1Y, 1M, 1C, and 1K is defined as a primary transfer nip formed between the second intermediate transfer belt 31 and the photosensitive members 1Y, 1M, 1C, and 1K.

At such primary transfer nip, Y, M, C, and K toner image on the respective photosensitive members 1Y, 1M, 1C, and 1K are super-imposingly transferred to the second intermediate transfer belt 31.

The second intermediate transfer belt 31 of endless type belt travels in a counter-clockwise direction as shown by an arrow in FIG. 1.

At each primary transfer nip, a primary transfer roller 32 and the photosensitive members 1Y, 1M, 1C, and 1K sandwich the second intermediate transfer belt 31, wherein the primary transfer roller 32 is applied with a primary transfer bias voltage by a power source (not shown).

With an effect of the primary transfer bias voltage and nip pressure, Y, M, C, and K toner image on the respective photosensitive members 1Y, 1M, 1C, and 1K are super-imposingly transferred to the second intermediate transfer belt 31 at each primary transfer nip.

The second intermediate transfer belt 31 and relating parts are integrated in the second image forming section 30, whereby the second image forming section 30 is detachable from the printing unit 100 as one unit.

Each of the first intermediate transfer belt 21 and second intermediate transfer belt 31 includes a base layer made of material such as resin film and rubber having a thickness of 50 to 600 μm, for example.

Such intermediate transfer belt (i.e., first intermediate transfer belt 21 and second intermediate transfer belt 31) has an electric resistance value which enables a transfer of toner image from the photosensitive member 1 to the surface of the intermediate transfer belt electro-statistically with an effect of a primary transfer bias voltage applied by the primary transfer roller 22 or 32.

For example, such intermediate transfer belt can be made by dispersing carbons in polyamide and adjusting a volume electric resistance value in a range of $10^6$ to $10^{12}$ Ω·cm.

Furthermore, each of the first intermediate transfer belt 21 and the second intermediate transfer belt 31 includes a belt-aligning rib at one lateral side of the belt or both lateral sides of the belt, wherein the belt-aligning rib is used for stabilizing a traveling direction of the belt.

The primary rollers 22 and 32 include the following structure, for example.

Specifically, the primary roller 22 and 32 include a core and an electro-conductive layer coated on the core. The core is made of a metal and the electro-conductive layer includes rubber material. The core is applied with a primary bias voltage from a power source (not shown).

In an exemplary additional embodiment, the electro-conductive layer can be made by dispersing carbons in urethane rubber and adjusting a volume electric resistance value to approximately $10^5$ Ω·cm.

The printing unit 100 can also produce a monochrome image by using only black toner. In case of producing a monochrome image, the process units 80Y, 80M, and 80C in the first image forming section 20 are not used.

The printing unit 100 includes a mechanism (not shown) to maintain a non-contact condition between the process units 80Y, 80M, and 80C and the first intermediate transfer belt 21 when producing a monochrome image and stopping an operation of the process units 80Y, 80M, and 80C.

For example, such mechanism includes an internal frame (not shown), which can move in a pivotable manner while supporting the roller 26 and the primary roller 22. By such pivoting of the internal frame, the first intermediate transfer belt 21 is disengaged from the photosensitive members 1Y, 1M, and 1C, and is contacted only to the photosensitive member 1K.

Then, the image forming apparatus 10 can produce a monochrome image using black toner. Such mechanism is preferable to prolong the lifetime of the photosensitive members.

Similarly, the second image forming section 30 also includes such mechanism to maintain a non-contact condition of the process units 81Y, 81M, and 81C and the second intermediate transfer belt 31 when the image forming apparatus 10 produces a monochrome image.

Hereinafter, an outline of a double-face transfer unit 50 according to an additional exemplary embodiment is explained with reference to FIG. 4.

Figure 4:
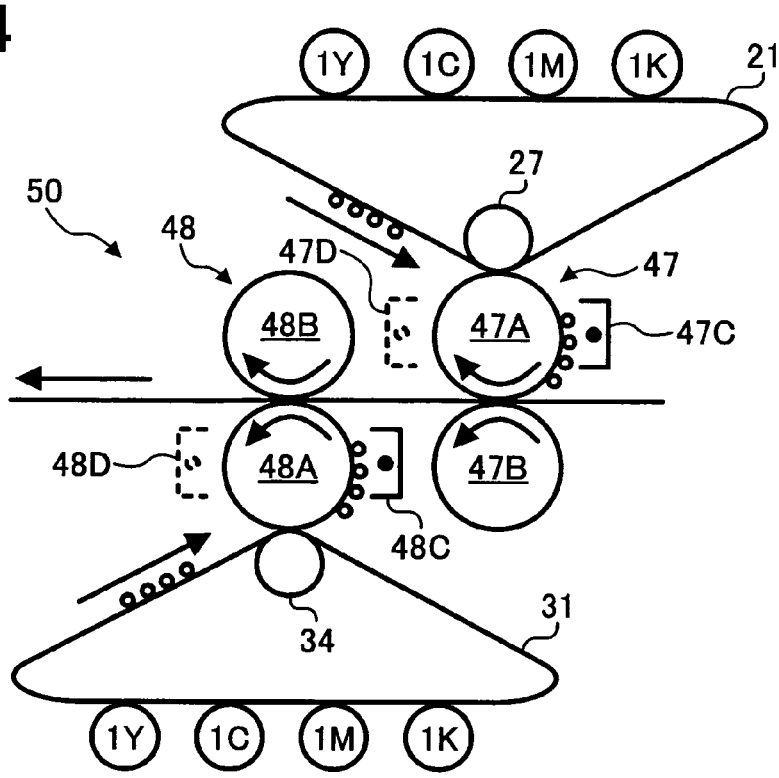
FIG. 4 is a schematic configuration of a double-face transfer unit in an image forming apparatus in FIG. 1.

As shown in FIG. 4, the double-face transfer unit 50 includes a first transfix unit 47 and a second transfix unit 48.

The first transfix unit 47 is provided at a position, which faces an outer surface of the first intermediate transfer belt 21, wherein the first intermediate transfer belt 21 is extended by the support roller 27 at such position.

The first transfix unit 47 includes a first heat roller 47A and a first pressure roller 47B.

Toner images are transferred from the first intermediate transfer belt 21 to the first heat roller 47A, and the first pressure roller 47B applies a given pressure to the first heat roller 47A.

When a transfer sheet P passes through a nip defined by the first heat roller 47A and the pressure roller 47B, toner images on the first heat roller 47A is transferred and fixed on the transfer sheet P.

The second transfix unit 48 is provided at a position, which faces an outer surface of the second intermediate transfer belt 31, wherein the second intermediate transfer belt 31 is extended by the support roller 34 at such position.

The second transfix unit 48 includes a second heat roller 48A and a second pressure roller 48B.

Toner images are transferred from the second intermediate transfer belt 31 to the second heat roller 48A, and the second pressure roller 48 applies a given pressure to the second heat roller 48A.

When the transfer sheet P passes through a nip defined by the second heat roller 48A and the second pressure roller 48B, toner images on the second heat roller 48A is transferred and fixed on the transfer sheet P.

The double-face transfer unit 50 will be explained in detail later.

As illustrated in FIG. 1, the sheet feed unit 40 is provided next to the printing unit 100. The sheet feed unit 40 stores a recording medium such as transfer sheet and supplies recording medium to the printing unit 100.

As illustrated in FIG. 1, the sheet feed unit 40 includes sheet feed trays 40*a*, 40*b*, 40*c*, and 40*d*, for example. The sheet feed tray 40*a* can store a large capacity of transfer sheets compared to the other sheet feed trays 40*b*, 40*c*, and 40*d*, for example.

Each of the sheet feed trays 40*a*, 40*b*, 40*c*, and 40*d* is configured to be withdrawable from the sheet feed unit 40. The sheet feed trays 40*a*, 40*b*, 40*c*, and 40*d* can store different types of transfer sheets therein.

An uppermost transfer sheet in the sheet feed trays 40*a*, 40*b*, 40*c*, and 40*d* can be fed to a sheet feed route 43B by corresponding feed devices 41A, 41B, 41C, and 41D, and then be transported to the sheet feed route 43A by a pair of transport rollers 42B.

As illustrated in FIG. 1, a pair of registration rollers 45 are provided in the sheet feed route 43A.

The pair of registration rollers 45 sandwich a transfer sheet P transported from the sheet feed unit 40, and stops rotation of the registration rollers 45 temporally.

The pair of registration rollers 45 can control a timing for feeding the transfer sheet P to the double-face transfer unit 50.

Furthermore, a cross-direction position corrector 44 is provided in the sheet feed route 43A to correct an orientation of transfer sheet with respect to a transport direction of the sheet feed route 43A.

Specifically, the cross-direction position corrector 44 corrects a sheet direction so that a cross-direction of the transfer sheet P, which is perpendicular to the transport direction in the sheet feed route 43A, does not deviate from a given transport direction.

The cross-direction position corrector 44 includes a configuration as described below. For example, the cross-direction position corrector 44 includes a reference guide in a lateral side portion of the sheet feed route 43A and rollers (not shown), for example.

The cross-direction position corrector 44 can push a lateral side of the transfer sheet with the reference guide to align the transfer sheet P in a given transport direction. The reference guide can be selectively set to a given position according to a size of the transfer sheet P.

The cross-direction position corrector 44 can also includes a jogger type configuration. In case of jogger type, both lateral sides of the transfer sheet P are pushed from both lateral directions of the transfer sheet P (i.e., from right and left direction) with respect to the transport direction of the transfer sheet for a plurality of times in a short period of time to align the transfer sheet in a given transport direction.

Furthermore, the annex sheet feed unit 300 can be provided next to the sheet feed unit 40 to feed transfer sheets to the printing unit 100 through a sheet feed route 43C having a plurality of pair of transport rollers 42C. The annex sheet feed unit 300 can include a configuration similar to the sheet feed unit 40. With providing the annex sheet feed unit 300, the image forming apparatus 10 can conduct a higher volume of printing.

As for the sheet feed tray 40*a* of the sheet feed unit 40, a height of an upper most transfer sheet in the sheet feed tray 40*a* is substantially similar to a height "h1" of the sheet feed route 43A as illustrated in FIG. 1, whereby the transfer sheet P can be fed from the sheet feed tray 40*a* to the sheet feed route 43A in a substantially horizontal direction without bending the transfer sheet P.

With such configuration, a transfer sheet having a greater thickness or higher stiffness can be fed from the sheet feed tray 40*a* to the sheet feed route 43A smoothly.

Furthermore, the sheet feed tray 40*a* preferably includes a vacuum mechanism (not shown) so that a various types of transfer sheets can be fed from the sheet feed tray 40*a*.

Although not shown, a sensor can be provided in the sheet feed routes 43A, 43B, and 43C to detect types of transfer sheet, and such detected information can be used to trigger signals for image forming operation.

After transferring and fixing the toner image on the transfer sheet P in the double-face transfer unit 50, the transfer sheet P is fed to a cooling unit 70 provided next to the double-face transfer unit 50 as illustrated in FIG. 1.

The cooling unit 70 cools the transfer sheet P to completely fix a toner image on the transfer sheet P within a shorter period of time. The cooling unit 70 can employ a heat-pipe roller to facilitate heat-radiating effect, for example.

The cooled transfer sheet P is ejected by a pair of sheet ejection rollers 71 and stacked on a sheet stack 75, provided in a left side of the printing unit 100 as illustrated in FIG. 1.

Furthermore, the transfer sheet P passed through the sheet stack 75 can be transported to another processing unit such as hole-punching unit, sheet-cutting unit, sheet-bending unit, and sheet-binding unit, for example.

As illustrated in FIG. 1, the operation/display unit 90 is provided on the top face of the printing unit 100.

The operation/display unit 90 includes a keyboard to input operating information such as image forming conditions.

The operation/display unit 90 also includes a display such as liquid crystal display (LCD) to display information thereon. An operator can use the display to facilitate information communication with the printing unit 100.

As illustrated in FIG. 1, the printing unit 100 includes the controller 95. The controller 95 includes power sources and control circuits placed on a circuit frame.

As illustrated in FIG. 1, the automatic document feeder (ADF) 200 is provided on the sheet feed unit 40.

The ADF 200 can automatically feed document sheets when to read document images. The information read by the ADF 200 is transmitted to the controller 95. Based on such information, the controller 95 controls the printing unit 100 to produce an image pattern read by the ADF 200.

Furthermore, a personal computer (not shown) can transmit image information to the printing unit 100, and the printing unit 100 can produce an image corresponding to such image information.

In addition, image information can be transmitted to the printing unit 100 from a telephone line (not shown), and the printing unit 100 can produce an image corresponding to such image information.

Hereinafter, an image forming process for forming a full-color toner image on one face of the transfer sheet P with the printing unit 100 is explained. Such process can be referred as one-face recording method.

The one-face recording method includes two types, which can be selected by an operator.

A first type of method is a process to transfer a four-color toner image to the first face of the transfer sheet P from the first intermediate transfer belt 21.

A second type of method is a process to transfer a four-color toner image to the second face of the transfer sheet P from the second intermediate transfer belt 31.

If images are produced on a plurality of transfer sheets, it is preferable to control an image forming sequence so that the plurality of transfer sheets can be stacked on the sheet stack 75 sequentially.

The above-mentioned first type of method can record images on transfer sheets in an order of from the last page to front page of documents.

On one hand, the above-mentioned second type of method can record images on transfer sheets in an order of from the front page to last page of documents.

Hereinafter, an image forming process using the first image forming section 20 for the above-mentioned first type of method is explained.

When the printing unit 100 is operated for image forming, the first intermediate transfer belt 21 and the photosensitive members 1Y, 1M, 1C, and 1K in the first process units 80Y, 80M, 80C, and 80K rotate.

At the same time, the photosensitive members 1Y, 1M, 1C, and 1K in the second process units 81Y, 81M, 81C, and 81K are disengaged from the second intermediate transfer belt 31, and are controlled to be in a non-rotating condition although the second intermediate transfer belt 31 travels in a counter-clockwise direction as shown by an arrow in FIG. 1.

Then, the first process unit 80Y starts an image forming process.

The optical writing unit 4, including an LED (light emitting diode) array and a focusing device, emits a light beam from the LED array, corresponding to the yellow image data, to form an electrostatic latent image for yellow image on the surface of the photosensitive member 1Y, which is uniformly charged by the scorotron charger 3.

The electrostatic latent image is developed as a yellow toner image by the developing unit 5 in the first process unit 80Y, and the yellow toner image is then electro-statistically transferred to the first intermediate transfer belt 21 at a primary transfer nip for yellow image.

Similarly, such developing and primary transfer processes are sequentially conducted on the photosensitive members 1M, 1C, and 1K with a given timing.

Then, magenta, cyan, and black toner image are sequentially and super-imposingly transferred on the yellow toner image formed on the first intermediate transfer belt 21 at respective primary transfer nip for magenta, cyan, and black image.

With such transfer process, a four-color toner image is formed on the first intermediate transfer belt 21.

As for the sheet feed unit 40, the transfer sheet P matched to a to-be-produced image can be supplied from any one of the sheet feed trays 40*a*, 40*b*, 40*c*, and 40*d* by using the feed devices 41A, 41B, 41C, and 41D.

Then, the pair of transport rollers 42B transport the transfer sheet P to the sheet feed route 43A in the printing unit 100. Then, the transfer sheet P is transported to the cross-direction position corrector 44.

The cross-direction position corrector 44 corrects the orientation of the transfer sheet P if the transfer sheet P is tilted from a given transport direction when the transfer sheet P is transported from the sheet feed unit 40 to the double-face transfer unit 50.

In an upstream of the transport direction with respect to the pair of registration rollers 45, the cross-direction position corrector 44 includes a guide plate (not shown), provided on each lateral side of the sheet feed route 43A.

Each guide plate (not shown) can be abutted to a lateral side of the transfer sheet P from each lateral side of the transfer sheet P to correct the orientation of the transfer sheet P if the transfer sheet P is tilted from the given transport direction.

The distance between the two guide plates can be adjusted in a direction perpendicular to the transport direction, by which the distance between the two guide plates can be adjusted depending on types of transfer sheet fed from the sheet feed unit 40. Therefore, such guide plates can be used for a variety of different types of transfer sheets fed from the sheet feed unit 40.

After correcting orientation of the transfer sheet P with the cross-direction position corrector 44, the transfer sheet P is fed to the pair of registration rollers 45.

The registration rollers 45 feed the transfer sheet P to the secondary transfer nip, defined by the first transfix unit 47, with a given timing.

At such secondary transfer nip, a first toner image (e.g., four-color toner image) formed on the first intermediate transfer belt 21 is transferred and fixed onto the first face of the transfer sheet P with an effect of heat and pressure of the first transfix unit 47.

At each of the first process units 80Y, 80M, 80C, and 80K, the cleaning unit 2 cleans the respective photosensitive members 1Y, 1M, 1C, and 1K to remove toners remaining on the photosensitive members 1Y, 1M, 1C, and 1K after transferring toner images to the first intermediate transfer belt 21 from the photosensitive members 1Y, 1M, 1C, and 1K.

As illustrated in FIG. 2, the cleaning unit 2 includes the cleaning brush 2*a* and cleaning blade 2*b* to remove toners remaining on the photosensitive member 1Y, 1M, 1C, and 1K.

Removed foreign objects such as toner are collected by the collector 2*c*, and then sent to the waste toner compartment 87.

The electric potential sensor S1 detects electric potential of the surface of the photosensitive member 1 scanned by a light beam.

The image sensor S2 detects toner concentration adhered to the surface of the photosensitive member 1 after developing the electrostatic latent image as a toner image.

The electric potential sensor S1 and the image sensor S2 transmit information to the controller 95, and the controller 95 adjusts image forming conditions based on such information.

After cleaning the surface of the photosensitive member 1 with the cleaning unit 2, the de-charging unit Q de-charges the photosensitive member 1 to prepare for a next image forming process.

After the transfer sheet P passes through the first transfix unit 47, the transfer sheet P is fed to the cooling unit 70. The cooling unit 70 includes at least one pair of cooling rollers.

After the full-color toner image is completely fixed on the transfer sheet P in the cooling unit 70, the transfer sheet P is ejected to the sheet stack 75 by the pair of sheet ejection rollers 71.

At the sheet stack 75, the ejected transfer sheets are sequentially stacked one by one in an order of "from last page to front page" of the document read by the ADF 200, thereby a page order of the ejected transfer sheets can be collated at the sheet stack 75.

The sheet stack 75 can be configured to be moved to a downward direction with an increased number of ejected transfer sheets, by which transfer sheets can be stacked with an order of "from last page to front page" of the document read by the ADF 200.

Furthermore, instead of stacking the transfer sheets directly on the sheet stack 75, the transfer sheets can be transported to another processing unit such as a hole-punching unit, a sorting unit, a collating unit, a sheet-cutting unit, a sheet-bending unit, and a sheet-binding unit, for example.

In the above explanation, the method of transferring a four-color toner image to the first face of the transfer sheet from the first intermediate transfer belt 21 is explained.

Similarly, the above-mentioned second type method for transferring a four-color toner image to the second face of the transfer sheet from the second intermediate transfer belt 31 can be used to record an image on one face of the transfer sheet. In this case, instead of using the first process units 80Y, 80M, 80C, and 80K, an image forming is conducted by using the second process units 81Y, 81M, 81C, and 81K.

The above-mentioned first and second type methods can record images on transfer sheets with a substantially similar manner each other except that the second type method can record images in an order of "from the front page to last page" of document read by the ADF 200. Therefore, an explanation for forming an image on one face of a transfer sheet with the second process units 81Y, 81M, 81C, and 81K is omitted.

Hereinafter, a both face image forming method for forming images on both faces (i.e., first and second face) of a transfer sheet P is explained.

When image signals are input to the printing unit 100, yellow, magenta, cyan, and black toner image are formed on the respective photosensitive members 1Y, 1M, 1C, and 1K in the first process units 80Y, 80M, 80C, and 80K as explained in the above described one-face image forming method.

Then, yellow, magenta, cyan, and black toner image are sequentially and super-imposingly transferred to the first intermediate transfer belt 21 at each primary transfer nip for Y, M, C, and K images.

When Y, M, C, and K toner images are formed in the first process units 80Y, 80M, 80C, and 80K, Y, M, C, and K toner images are also formed on the photosensitive members 1Y, 1M, 1C, and 1K in the second process units 81Y, 81M, 81C, and 81K in a substantially concurrent manner.

Similarly to the first intermediate transfer belt 21, the Y, M, C, and K toner images are sequentially and super-imposingly transferred to the second intermediate transfer belt 31 at each primary transfer nip for Y, M, C, and K toner images.

With such processes, the four-color toner image is formed on each of the first intermediate transfer belt 21 and the second intermediate transfer belt 31.

The transfer sheet P is stopped at the pair of registration rollers 45 and then fed from the pair of registration rollers 45.

The pair of registration rollers 45 feed a transfer sheet P to the first transfix unit 47 at a given timing.

At the first transfix unit 47, the four-color toner image is transferred and fixed on the transfer sheet P from the second intermediate transfer belt 21 with an effect of heat and pressure.

Then, the transfer sheet P is transported to the second transfix unit 48 from the first transfix unit 47.

At the second transfix unit 48, the four-color toner image is transferred and fixed on the second face of the transfer sheet P from the second intermediate transfer belt 31 with an effect of heat and pressure.

With such process, the full-color toner image is formed on both faces (i.e., the first and second face) of the transfer sheet P.

Then, the transfer sheet P is fed to the cooling unit 70. After the toner images are firmly fixed on the transfer sheet P, the transfer sheet P is ejected to the sheet stack 75 by the pair of sheet ejection rollers 71.

In case of forming images on both faces (i.e., first and second face) of a plurality of transfer sheets, the stacking sequence of the transfer sheets on the sheet stack 75 is controlled so that a first transfer sheet, having an image of page 1 and an image of page 2 of the document on both faces of the first transfer sheet, can be stacked on a surface of the sheet stack 75 by facing the image of page 1 to the surface of the sheet stack 75.

Similarly, a second transfer sheet, having an image of page 3 and an image of page 4 of the document on both faces of the second transfer sheet, is stacked on the page 2 of the first transfer sheet by facing the image of page 3 of the second transfer sheet to the image of page 2 of the first transfer sheet. Such stacking is continued for each transfer sheet having images on both faces thereof. After finishing such stacking, a bundle of the transfer sheets can be picked up from the sheet stack 75.

Accordingly, the page order of the transfer sheets can be set from "page 1, page 2, page 3, and so on."

The controller 95 can control such image forming sequence of the transfer sheets and can adjust electric power to be supplied to the double-face transfer unit 50. For example, the controller 95 controls electric power to a higher level when conducting a both-face image forming mode compared to one-face image forming mode.

In the above description, the method of forming full-color image on one face or both faces (i.e., first and second face) of a transfer sheet is explained, but such method can be also used for forming a monochrome image on one face or both faces (i.e., first and second face) of a transfer sheet.

As for the image forming apparatus 10, if maintenance work or replacement work is required for the image forming apparatus 10, an outer cover (not shown) can be opened to conduct the maintenance work or replacement work. Once the outer cover (not shown) is opened, replacement units or parts can be removed from the image forming apparatus 10.

Hereinafter, the double-face transfer unit 50 is explained in detail with reference to FIG. 4. As above-mentioned, the double-face transfer unit 50 includes the first transfix unit 47 and second transfix unit 48.

The first transfix unit 47 includes the first heat roller 47A and the first pressure roller 47B. The second transfix unit 48 includes the second heat roller 48A and the second pressure roller 48B.

As shown in FIG. 4, a first coil 47C is provided near the first heat roller 47A and a second coil 48C is provided near the second heat roller 48A.

The first coil 47C (or second coil 48C) includes an induction coil, by which the first heat roller 47A (or second heat roller 48A) can be heated with an electromagnetic induction effect.

The first coil 47C generates a magnetic field around a surface layer of the first heat roller 47A, and the second coil 48C generates a magnetic field around a surface layer of the second heat roller 48A.

The first heat roller 47A and second heat roller 48A may include a magnetic substance, which can be heated with an electromagnetic induction effect of the magnetic field generated by the first coil 47C and second coil 48C.

With such configuration, the toner image on the first heat roller 47A (or second heat roller 48A) can be heated by two heating source: 1) the first coil 47C (or second coil 48C); and 2) the magnetic substance in the first heat roller 47A (or second heat roller 48A).

Furthermore, a separation claw (not shown) may be provided to the first heat roller 47A to prevent sticking of the transfer sheet P to the first heat roller 47A after the transfer sheet P passed through the first heat roller 47A.

Furthermore, in a similar manner, a separation claw (not shown) may be provided to the second heat roller 48A to prevent a sticking of the transfer sheet P to the second heat roller 48A after the transfer sheet P passed through the second heat roller 48A.

A first toner image (e.g., four-color toner image) on the first intermediate transfer belt 21 is transferred to the first heat roller 47A, and then the first toner image is transported to a first transfer/fixing nip, defined by the first heat roller 47A and the first pressure roller 47B, with a rotation of the first heat roller 47A.

During such transportation process, the first toner image on the first heat roller 47A can be softened (or melted) with a heat on the first heat roller 47A.

At the first transfer/fixing nip, the first toner image is transferred and fixed on the first face of the transfer sheet P, wherein the first face is an upper face in FIG. 4.

Similarly, a second toner image (e.g., four color toner image) on the second intermediate transfer belt 31 is transferred to the second heat roller 48A, and then transported to a second transfer/fixing nip, defined by the second heat roller 48A and the pressure roller 48B, with a rotation of the second heat roller 48A.

During such transportation process, the second toner image on the second heat roller 48A can be softened (or melted) with a heat on the second heat roller 48A.

At the second transfer/fixing nip, the second toner image is transferred and fixed on the second face of the transfer sheet P, wherein the second face is a lower face in FIG. 4.

In case of electrostatic transfer method, dust generation or image bleeding may occur on a resultant image due to an electric discharge or electric field at an entrance and exit of a transfer nip.

On one hand, in case of the above-mentioned heat and transfer method, such dust generation or image bleeding may not occur on a resultant image because electric discharge or electric field does not occur at the entrance and exit of a transfer nip. Accordingly, a high quality image can be produced with the heat and transfer method.

In an example embodiment, the toner image is transferred from the intermediate transfer belt (e.g., 21, 31) to the heat roller (e.g., 47A, 48B) with the heat and transfer method, and the toner image is transferred and fixed from the heat roller (e.g., 47A, 48B) to the transfer sheet P with the heat and transfer method.

In another exemplary embodiment, the toner image is transferred from the photosensitive member 1 to the intermediate transfer belt (e.g., 21, 31) with the electrostatic transfer method.

With such configuration, an image deterioration caused by the electrostatic transfer method may be reduced, and a higher image quality can be obtained with the image forming apparatus 10.

The first heat roller 47A includes a core, a heat-resistance elastic layer, a heating layer, and a surface layer.

The core is made as a metal roller, for example. The heat-resistance elastic layer, made of heat-resistance rubber (e.g., silicone rubber), is coated on the core.

The heating layer, made of magnetic substance (e.g., iron, cobalt, nickel), is coated on the heat-resistance elastic layer.

The surface layer is coated on the heating layer, wherein the surface layer has heat-resistance and toner separation property.

The second heat roller 48A includes a similar configuration of the first heat roller 47A.

The heat-resistance elastic layer preferably mitigates a thickness effect of the transfer sheet P when the transfer sheet P passes through the transfer nip. If there is no heat-resistance elastic layer, the first heat roller 47A (or second heat roller 48A) may unfavorably vibrate when the transfer sheet P passes through the transfer/fixing nip.

With such configuration, vibration of first heat roller 47A (or second heat roller 48A) can be suppressed, by which a disturbance may not occur on toner images on the first heat roller 47A (or second heat roller 48A).

The surface layer preferably has a lower volume resistivity, for example, 109 □cm or less. With such lower volume resistivity, an electromagnetic induction current is more likely to flow in the surface layer of the heat rollers (e.g., 47A, 48A), by which the heat rollers (e.g., 47A, 48A) can be heated efficiently.

Furthermore, by including the heating layer having magnetic substance, the heat rollers (e.g., 47A, 48A) can be heated efficiently.

The heating layer preferably includes a magnetic substance with an amount of 30 wt % (weigh percent) or greater. If the amount of the magnetic substance is less than 30 wt %, the surface layer may not be effectively heated.

The coils (e.g., 47C, 48C) generate a magnetic field when electric current flows in the coils (e.g., 47C, 48C) The magnetic field heats the heating layer with an electromagnetic induction effect, and thereby the heat rollers (e.g., 47A, 48A) can be heated.

As shown in FIG. 4, the first coil 47C (or second coil 48C) is provided in an upstream of a transfer/fixing nip, defined by the first heat roller 47A (or second heat roller 48A) aid the first pressure roller 47B (or second pressure roller 48B).

With such configuration, the area carrying a toner image on the first heat roller 47A (or second heat roller 48A) can be heated to a higher temperature as compared with another area on the first heat roller 47A (or second heat roller 48A) not carrying the toner image. Accordingly, the toner image on the first heat roller 47A (or second heat roller 48A) can be softened (or melted) effectively.

Furthermore, if a magnetic substance is included in toner particles, the toner particles can be heated effectively when the toner particles come to a position facing the first coil 47C (or second coil 48C), and by which the toner particles may be softened (or melted) more effectively.

The toner particles preferably include the magnetic substance with an amount of 30 wt % or greater. If the amount of the magnetic substance in the toner particles is less than 30 wt %, the toner particles may not be effectively heated.

The first heat roller 47A (or second heat roller 48A) may be heated to a higher temperature such as 100 to 200 Celsius degree for softening (or melting) toners.

As shown in FIG. 4, the first intermediate transfer belt 21 (or second intermediate transfer belt 31) is provided closely to the first heat roller 47A (or second heat roller 48A).

If the surface layer of the first heat roller 47A (or second heat roller 48A) and the first intermediate transfer belt 21 (or second intermediate transfer belt 31) have a lower glass transition temperature (e.g., less than 200 Celsius degree), the surface layer of the first heat roller 47A (or second heat roller 48A) and the first intermediate transfer belt 21 (or second intermediate transfer belt 31) may be deformed by occurrence of a high temperature, by which an abnormal image may occur on a resulting image.

Accordingly, the first intermediate transfer belt 21 (or second intermediate transfer belt 31) and the surface layer of the first heat roller 47A (or second heat roller 48A) preferably have a heat resistance property, which can prevent the above-mentioned heat deformation at a high temperature such as 250 Celsius degree or greater, for example.

Furthermore, the surface layer of the first heat roller 47A (or second heat roller 48A) can be heated directly by the first coil 47C (or second coil 48C). Accordingly, the surface layer of the first heat roller 47A (or second heat roller 48A) preferably has a higher heat resistance compared to the first intermediate transfer belt 21 (or second intermediate transfer belt 31).

The above-mentioned heat and transfer method is explained below.

When a given pressure is applied to the softened (or melted) toners, the toner deforms plastically. Such deformed toners may fit into concavities and convexities on a transfer-related surface, wherein the transfer-related surface includes a surface of the intermediate transfer belts (e.g., 21 and 31), heat rollers (e.g., 47A and 48A), and the transfer sheet P.

The larger the surface roughness of the transfer-related surface, the larger the contact area of the transfer-related surface.

If one transfer-related surface has a larger surface roughness than another transfer-related surface, softened (or melted) toners are more likely to fit into concavities and convexities on the one transfer-related surface having a larger surface roughness.

If two transfer-related surfaces have a similar surface roughness, softened (or melted) toners may more likely to fit into concavities and convexities on one transfer-related surface having a lower toner separation property.

Therefore, in order to maintain good transferability to the transfer sheet P, the transfer sheet P may have a surface roughness, which is larger than a surface roughness of the intermediate transfer belts (e.g., 21 and 31) and heat rollers (e.g., 47A and 48A).

Furthermore, good transferability to the transfer sheet P may be obtained by setting a relatively larger toner separation property to the surface of the intermediate transfer belts (e.g., 21 and 31) and heat rollers (e.g., 47A and 48A) compared to the transfer sheet P.

For example, if the transfer sheet P is a plain paper sheet, the transfer sheet P may have a surface roughness of 30 to 50 μm, and the intermediate transfer belts (e.g., 21 and 31) and heat rollers (e.g., 47A and 48A) preferably have a surface roughness of 10 μm or less, which is smaller than the surface roughness of transfer sheet P.

Furthermore, the toner separation property can be indirectly evaluated with a contact angle of water.

The contact angle of water is an angle that a small drop of pure water makes as it meets the surface of a horizontal surface, wherein the small drop of pure water is placed on the horizontal surface very quietly.

The larger the contact angle of water, the smaller the surface energy. If a surface has a lower surface energy, such surface may not adhere with other material effectively.

Accordingly, by setting the contact angle of water on the surface of the intermediate transfer belts (e.g., 21 and 31) and heat rollers (e.g., 47A and 48A) at a 90 degree or greater, a surface energy of the intermediate transfer belts (e.g., 21 and 31) and heat rollers (e.g., 47A and 48A) can be set to a smaller level, by which toners less likely to stick on the surface of the intermediate transfer belts (e.g., 21 and 31) and heat rollers (e.g., 47A and 48A). Accordingly, the intermediate transfer belts (e.g., 21 and 31) and heat rollers (e.g., 47A and 48A) can have a surface layer having a preferable toner separation property.

Furthermore, the surface of the intermediate transfer belts (e.g., 21 and 31) preferably has a smoother surface as compared to the surface of the heat rollers (e.g., 47A and 48A), by which the toner image can be separated from the surface of the intermediate transfer belts (e.g., 21 and 31) more easily when the toner image is transferred from the intermediate transfer belts (e.g., 21 and 31) to the heat rollers (e.g., 47A and 48A).

Accordingly, the toner image can be effectively transferred from the intermediate transfer belt (e.g., 21 and 31) to the heat rollers (e.g., 47A and 48A).

The intermediate transfer belts (e.g., 21 and 31) and the surface layer of the heat rollers (e.g., 47A and 48A) are preferably made of a heat resistance resin.

The heat resistance resin includes a principal chain having a heat resistance property and a side chain, extended from the principal chain and having a toner separation property.

The principal chain includes polyimide structure, polybenzimidazole structure, and polyamide structure, for example.

The side chain includes polysiloxane structure, for example, which has the toner separation property. The polysiloxane structure for the side chain includes dimethyl polysiloxane structure, methylphenyl polysiloxane structure, and diphenyl polysiloxane structure, for example.

Such heat resistance resin is available as polyimide silicone resin such as PIX (produced by Hitachi Chemical Co., Ltd.), KJR (produced by Shin-Etsu Chemical Co., Ltd.), and higher temperature type BE (produced by Beregston & Associates), for example.

By using such materials, the intermediate transfer belts (e.g., 21 and 31) and the surface layer of the heat rollers (e.g., 47A and 48A) can include a heat resistance property and toner separation property.

Furthermore, the intermediate transfer belts (e.g., 21 and 31) and the surface layer of the heat rollers (e.g., 47A and 48A) can include heat resistance resin (e.g., polyimide, polybenzimidazole and polyamide), which is coated by fluorinated resin or silicone resin having toner separation property.

As above-discussed, the surface layer of the heat rollers (e.g., 47A and 48A) preferably has a higher heat resistance compared to the intermediate transfer belts (e.g., 21 and 31), and the surface layer of the heat rollers (e.g., 47A and 48A) preferably has a lower toner separation property compared to the intermediate transfer belts (e.g., 21 and 31).

Therefore, the intermediate transfer belts (e.g., 21 and 31) may be made of polyimide resin coated with Teflon (registered trademark), and the surface layer of the heat rollers (e.g., 47A and 48A) may be made of polyamide, which has a higher heat resistance compared to polyimide, for example.

Then, a toner separation property of the intermediate transfer belts (e.g., 21 and 31), heat rollers (e.g., 47A and 48A), and transfer sheet P can be set from a larger value to a smaller value in a order of: intermediate transfer belt (largest value), heat rollers (middle value), and transfer sheet (smallest value).

With such configuration, toner images can be transferred to the transfer sheet P effectively.

Furthermore, a surface roughness of the intermediate transfer belts (e.g., 21 and 31), heat rollers (e.g., 47A and 48A), and transfer sheet P can be set from a smaller value to a larger value in the order of: intermediate transfer belt (smallest value), heat rollers (middle value), and transfer sheet (largest value).

With such configuration, toner images can be transferred to the transfer sheet P effectively.

As shown in FIG. 4, the first coil 47C (or second coil 48C) is provided in an upstream side of a transfer/fixing nip, defined by the first heat roller 47A (or second heat roller 48A) and the first pressure roller 47B (or second pressure roller 48B). In such configuration, the first coil 47C (or second coil 48C) heats the first heat roller 47A (or second heat roller 48A) before the toner image is transferred to the transfer sheet P.

Furthermore, as shown in FIG. 4, the first coil 47C (or second coil 48C) is provided in a downstream side of a transfer nip, defined by the first heat roller 47A (or second heat roller 48A) and the first intermediate transfer belt 21 (or second intermediate transfer belt 31) as shown in FIG. 4, wherein the first intermediate transfer belt 21 (or second intermediate transfer belt 31) has no toner image thereon at the downstream side of the transfer nip because the toner image is transferred to the first heat roller 47A (or second heat roller 48A) at the transfer nip.

In such configuration, the transfer sheet P or the first pressure roller 47B (or second pressure roller 48B) may absorb (or deprive) some heat from the first heat roller 47A (or second heat roller 48A).

If such heat-deprived first heat roller 47A (or second heat roller 48A) comes to a position to the transfer nip, defined by the first intermediate transfer belt 21 (or second intermediate transfer belt 31) and first heat roller 47A (or second heat roller 48A), a toner image may not be effectively transferred from the first intermediate transfer belt 21 (or second intermediate transfer belt 31) to the first heat roller 47A (or second heat roller 48A).

In such a case, another coil may be additionally provided in another position as shown in FIG. 4.

For example, a first additional coil 47D (or second additional coil 48D), shown in dotted lines, may be additionally provided in a downstream of the transfer/fixing nip, defined by the first heat roller 47A (or second heat roller 48A) and the first pressure roller 47B (or second pressure roller 48B), as shown in FIG. 4.

With such configuration, even if the transfer sheet P and the first pressure roller 47B (or second pressure roller 48B) absorb (or deprive) some heat from the first heat roller 47A (or second heat roller 48A) around the transfer/fixing nip, the first heat roller 47A (or second heat roller 48A) can be effectively heated with the first additional coil 47D (or second additional coil 48D).

Accordingly, the first heat roller 47A (or second heat roller 48A) can have enough amount of heat when the first heat roller 47A (or second heat roller 48A) comes to the transfer nip, defined by the first intermediate transfer belt 21 (or second intermediate transfer belt 31) and the first heat roller 47A (or second heat roller 48A).

Therefore, a toner image on the first intermediate transfer belt 21 (or second intermediate transfer belt 31) can be softened (or melted), and can be transferred to the first heat roller 47A (or second heat roller 48A) effectively.

Furthermore, as above discussed, the surface layer of the first heat roller 47A (or second heat roller 48A) may include a magnetic substance, which can be heated by the first additional coil 47D (or second additional coil 48D), by which the surface layer of the first heat roller 47A (or second heat roller 48A) can be effectively heated.

With such configuration, a toner image on the first intermediate transfer belt 21 (or second intermediate transfer belt 31) can be softened (or melted) effectively, and then transferred to the first heat roller 47A (or second heat roller 48A) effectively.

In an example embodiment, a toner image on the intermediate transfer belts (e.g., 21, 31) is firstly transferred to the heat rollers (e.g., 47A, 48A).

The coils (e.g., 47C, 48C) heat the heat rollers (e.g., 47A, 48A) to soften (or melt) the toner image on the heat rollers (e.g., 47A, 48A).

Then, the softened (or melted) toner image is transferred and fixed onto the transfer sheet P.

Therefore, the toner image can be transferred and fixed on the transfer sheet P without directly heating the intermediate transfer belts (e.g., 21, 31).

Accordingly, a temperature increase of the intermediate transfer belts (e.g., 21, 31) can be suppressed, and thereby the process unit (e.g., 20, 30) in the image forming apparatus 10 may not be affected by a temperature of the intermediate transfer belts (e.g., 21, 31).

Furthermore, in an exemplary embodiment, the toner image on the heat rollers (e.g., 47A, 48A) can be softened (or melted) before the toner image on the heat roller (e.g., 47A, 48A) is transported to the transfer/fixing nip.

In a conventional fixing unit, the toner image is softened (or melted) and fixed on a transfer sheet at a fixing nip in a fixing unit. In such fixing unit, the transfer sheet may absorb some amount of heat from the fixing unit. Accordingly, a larger amount of heat may be required to soften (or melt) the toner image in the conventional fixing unit.

In the above discussed example embodiment, a toner image can be softened (or melted) on the heat roller (e.g., 47A, 48A) before the toner image is transported to the transfer/fixing nip. In such configuration, heat energy is used for heating the toner image on the heat roller, but not used for heating the transport sheet.

Accordingly, as compared to a conventional fixing unit which heats a transfer sheet and toner image at the fixing nip at the same time, the amount of heat for softening (or melting) toner image on the heat roller (e.g., 47A, 48A) can be set smaller.

With such configuration in an example embodiment, an energy consumption and temperature increase in the image forming apparatus 10 can be suppressed, by which the image forming apparatus 10 can improve its energy saving function.

Furthermore, in an exemplary embodiment, the amount of heat to be applied to the transfer sheet P can be made smaller as compared to the conventional fixing unit, by which a temperature of the transfer sheet P, which is ejected from the image forming apparatus 10, can be made lower. Accordingly, the temperature of the transfer sheet P can be decreased in a shorter time after fixing the toner image thereon.

Therefore, even when a high speed printing is conducted in the image forming apparatus 10, the toner image fixed on a first sheet may not adhere onto a second sheet, which may be stacked on the first sheet at the sheet stack 75.

When the double-face transfer unit 50 shown in FIG. 4 is used in the image forming apparatus 10, the first toner image is transferred and fixed onto the first face of the transfer sheet P, and then the second toner image is transferred and fixed onto the second face of the transfer sheet P.

Figure 5:
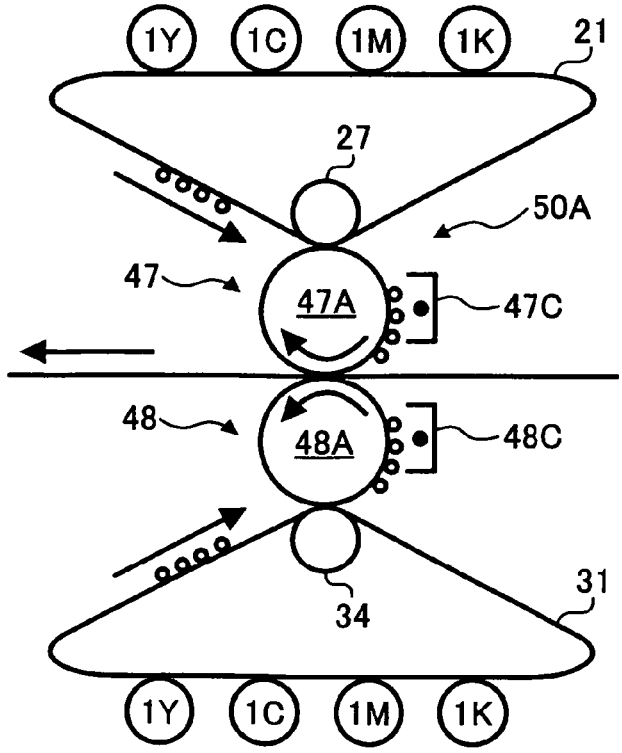
FIG. 5 is a schematic configuration of another double-face transfer unit in an image forming apparatus in FIG. 1.
Figure 6:
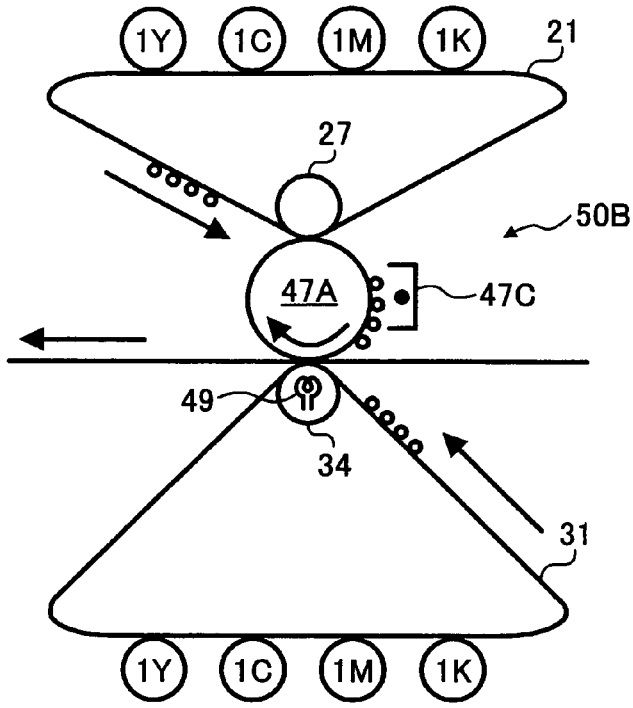
FIG. 6 is a schematic configuration of another double-face transfer unit in an image forming apparatus in FIG. 1.

However, the first and second toner image can be transferred and fixed onto the first and second face of the transfer sheet P simultaneously as shown FIGS. 5 and 6.

FIG. 5 shows another type of double-face transfer unit. A double-face transfer unit 50A shown in FIG. 5 includes a first transfix unit 47, and a second transfix unit 48, wherein the transfer sheet P is transported between the first transfix unit 47 and second transfix unit 48.

The first transfix unit 47 includes a first heat roller 47A and a first coil 47C. The second transfix unit 48 includes a second heat roller 48A and a second coil 48C.

As shown in FIG. 5, the first heat roller 47A and second heat roller 48A defines a transfer/fixing nip therebetween. In other words, the second heat roller 48A may be functioned as a pressure member for the first transfix unit 47, and the first heat roller 47A may be functioned as a pressure member for the second transfix unit 48.

A first toner image is transferred from the first intermediate transfer belt 21 to the first heat roller 47A. The first toner image is softened (or melted) with heat generated on the first heat roller 47A, and then transported to a transfer/fixing nip with a rotation of the first heat roller 47A.

A second toner image is transferred from the second intermediate transfer belt 31 to the second heat roller 48A. The second toner image is softened (or melted) with heat generated on the second heat roller 48A, and then transported to the transfer/fixing nip with a rotation of the second heat roller 48A.

The first and second toner image are simultaneously transported to the transfer/fixing nip, and respectively transferred and fixed onto the first and second face of the transfer sheet P with an effect of heat and pressure applied from the first heat roller 47A and second heat roller 48A.

FIG. 6 shows another type of double-face transfer unit. A double-face transfer unit 50B shown in FIG. 6 includes a first heat roller 47A, and a first coil 47C.

As shown in FIG. 6, the second intermediate transfer belt 31 and the first heat roller 47A defines a transfer/fixing nip therebetween.

Specifically, the second intermediate transfer belt 31 is extended by a support roller 34 as shown in FIG. 6, wherein the support roller 34 applies a given pressure to the first heat roller 47A at the transfer/fixing nip.

As similar to the above-discussed configurations shown in FIGS. 4 and 5, the first coil 47C can be provided next to the first heat roller 47A to heat the first heat roller 47A.

As for the double-face transfer unit 50B shown in FIG. 6, a first toner image is transferred from the first intermediate transfer belt 21 to the first heat roller 47A. The first toner image is softened (or melted) with a heat on the first heat roller 47A, and transported to a transfer/fixing nip with a rotation of heat roller 47A.

On one hand, a second toner image on the second intermediate transfer belt 31 is directly transported to the transfer/fixing nip.

The first toner image is transferred and fixed onto the first face of the transfer sheet P at the transfer/fixing nip with an effect of a nip pressure.

On one hand, the second toner image on the second intermediate transfer belt 31 is softened (or melted) with a heat effect of the first heat roller 47A, and transferred and fixed onto the second face of the transfer sheet P at the transfer/fixing nip with an effect of a nip pressure.

Furthermore, as shown in FIG. 6, the support roller 34 can include an auxiliary heater 49 such as halogen heater, by which the second toner image on the second intermediate transfer belt 31 can be heated more effectively.

Figure 7:
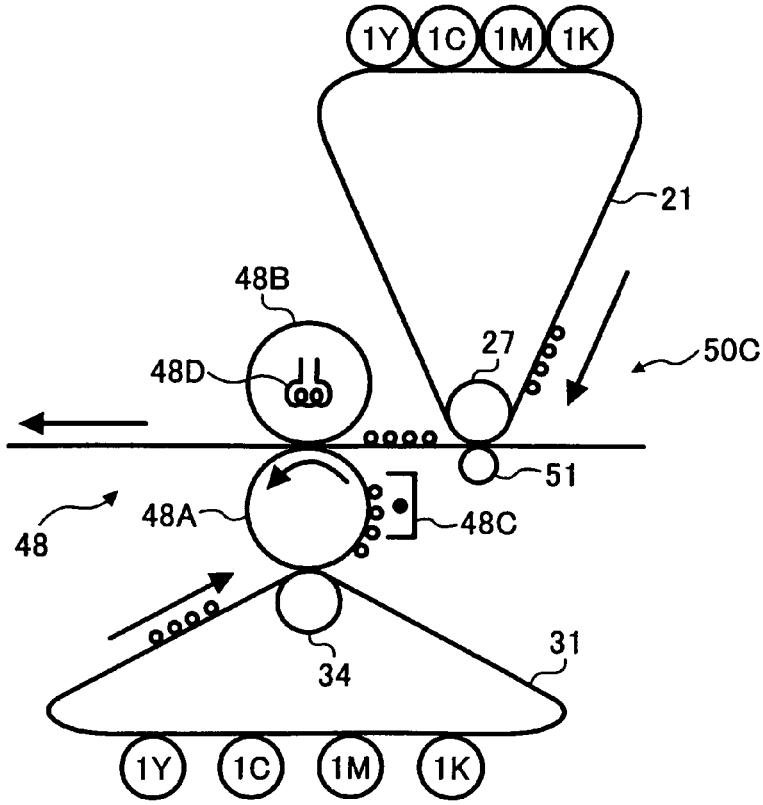
FIG. 7 is a schematic configuration of another double-face transfer unit in an image forming apparatus in FIG. 1.

FIG. 7 shows another type of double-face transfer unit. A double-face transfer unit 50C shown in FIG. 7 includes a transfer roller 51 and a transfix unit 48.

The transfer roller 51, which functions as electrostatic transfer unit, is provided in an upstream of the transfix unit 48 with respect to a transport direction of the transfer sheet P as shown in FIG. 7.

A first toner image is transferred from the first intermediate transfer belt 21 to the first face of the transfer sheet P with an electrostatic effect of the transfer roller 51, and then the transfer sheet P is transported to a transfer/fixing nip in the transfix unit 48.

On one hand, a second toner image is transferred from the second intermediate transfer belt 31 to the second heat roller 48A. The second toner image is softened (or melted) with heat generated on the second heat roller 48A, and then transported to the transfer/fixing nip, defined by the second heat roller 48A and second pressure roller 48B.

The first toner image is softened (or melted) with heat on the second heat roller 48A, and then fixed on the first face of the transfer sheet P at the transfer/fixing nip.

The second toner image on the second heat roller 48A is transferred and fixed onto the second face of the transfer sheet P with an effect of nip pressure at the transfer/fixing nip.

As shown in FIG. 7, the second pressure roller 48B can include an auxiliary heater 48D such as halogen heater, by which the toner image can be heated more effectively.

Figure 8:
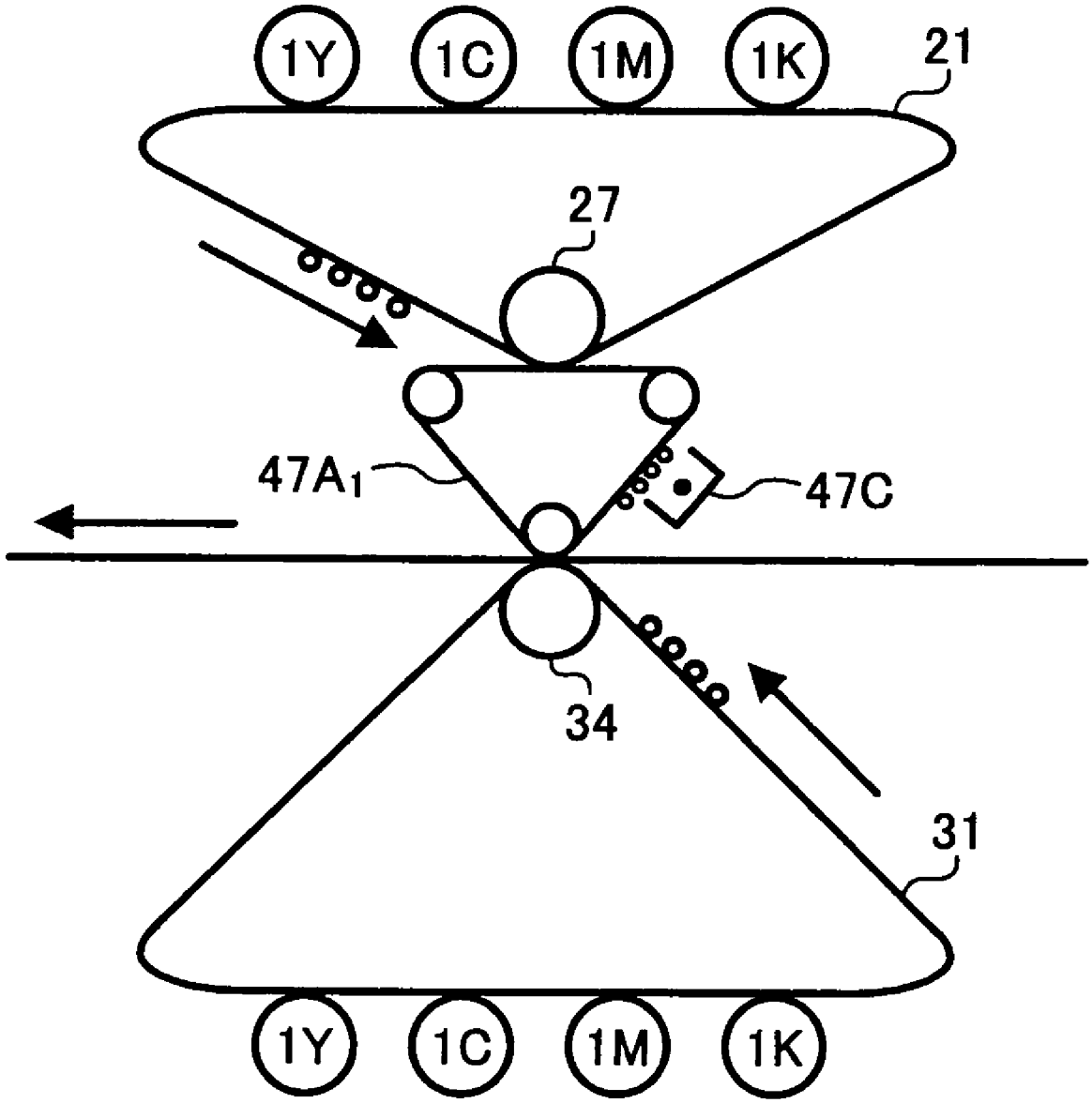
FIG. 8 is a schematic configuration of another double-face transfer unit in an image forming apparatus in FIG. 1, in which a heat member is formed in belt shape.

Although the first heat roller 47A is used as a heating member in the above discussed example embodiments, a belt shaped heating member can be used instead of the first heat roller 47A as shown in FIG. 8.

A heat belt 47A1 shown in FIG. 8 may include a base layer, a heating layer, and a surface layer.

The base layer can be made of a heat resistance resin. The heating layer can be coated on the base layer, and the surface layer can be coated on the heating layer.

The base layer, heating layer, and surface layer can be made with the method described in the above example embodiments.

The belt shaped heat member (e.g., heat belt 41$A_1$) can increase the design layout options in the image forming apparatus 10.

Furthermore, the belt shaped heat member (e.g., heat belt 41A1) can use a relatively larger area for transfer/fixing nip, and thereby fixing of toner image can be conducted more effectively.

In the above discussed example embodiments, the first coil 47C (or second coil 48C) heats the first heat roller 47A (or second heat roller 48A) with an electromagnetic induction effect.

However, other types of heaters such as halogen lamp can be used for heating the first heat roller 47A (or second heat roller 48A) with an effect of radiant heat of heater. Although such heat-radiant type heater can be used instead of an electromagnetic induction type heater, the electromagnetic induction type heater is preferably used from the viewpoint of heating efficiency and energy savings.

The electromagnetic induction type heater can directly heat the heat roller or heat belt with an electromagnetic induction effect. In other words, the electromagnetic induction type heater can heat the heat roller or heat belt from the inside of the heat roller or heat belt.

The heat-radiant type heater can heat the heat roller or heat belt with an effect of radiant heat. In other words, the heat-radiant type heater can heat the heat the heat roller or heat belt from outside the heat roller or heat belt. Therefore, the heating efficiency of the heat-radiant type may become lower compared to the electromagnetic induction type heater.

Accordingly, when considering a heating efficiency and energy saving of the image forming apparatus 10, the electromagnetic induction type heater is preferably used for heating a heating member such as heat roller or heat belt.

As for the image forming apparatus 10, toner particle having following (a) to (f) conditions is preferably used.

(a) softening point (or melting point) is 60 to 140 Celsius degree, viscoelasticity rate is 10 to 106 Pa when a temperature is at a softening point (or melting point) or greater, and a mixing ratio of colorant with respect to binding resin is from 1 to 30 wt %;

(b) weight average particle diameter is 3 to 8 μm;

(c) a ratio D4/D1 is 1.00 to 1.40, wherein D4 is the weight average particle diameter, and D1 is the number average particle diameter;

(d) a first shape factor SF-1 is 100 to 180;

(e) a second shape factor SF-2 is 100 to 190; and (f) fine particles having an average particle diameter of 50 to 500 nm and bulk density of 0.3 g/$cm^3$ or greater are added on a surface of toner particle.

The toner having conditions (a) to (f) is preferably used for improving transferability of toner image from the intermediate transfer belt (e.g., 21, 31), to the heat roller (e.g., 47A, 48B), and for improving transferability of toner image from the heat roller (e.g., 47A and 48B) to the transfer sheet P.

A manufacture or seller of image forming apparatus can notify such recommended toner information to users with following methods: 1) shipping of toner having (a) to (f) conditions with an image forming apparatus; 2) describing a product number or the name of a toner on an image forming apparatus or an operation manual; 3) informing a product number or name of toner to users with a document or electronic data; and 4) shipping of an image forming apparatus by setting toner bottles containing toners having (a) to (f) conditions, for example.

Although the image forming apparatus 10 can employ all of the above-mentioned methods for notifying the recommended toner information to users, one of the above-mentioned methods can be used instead of employing all of the above-mentioned methods.

The above-mentioned condition (a) is recommended for following reason.

If a softening point (or melting point) of toner becomes high, the heat roller (e.g., 47A, 48A) may be required to be heated to a higher temperature to soften (or melt) the toner. If the heat roller (e.g., 47A, 48A) is heated to a higher temperature, components around the heat roller (e.g., 47A, 48A) may be deformed or damaged due to the highly heated heat roller (e.g., 47A, 48A).

Furthermore, an energy consumption in the image forming apparatus 10 may be unfavorably increased if the heat roller (e.g., 47A, 48A) is heated to a higher temperature.

Accordingly, by setting the softening point (or melting point) of toner at 140 Celsius degree or less, the heat roller (e.g., 47A, 48A) may not be required to be heated to a higher temperature to soften (or melt) the toner, by which heat deformation or damage to the components around the heat roller (e.g., 47A, 48A) can be suppressed.

Furthermore, by setting the softening point (or melting point) of toner at 140 Celsius degree or less, the energy consumption for heating the heat roller (e.g., 47A, 48A) can be reduced, by which an energy saving of the image forming apparatus 10 can be improved.

Furthermore, by setting the softening point (or melting point) of toner at 60 Celsius degree or greater, toner may not be softened (or melted) at room temperature.

The toner includes a binding resin, which is mixed with wax. Therefore, the toner can be melted at a temperature lower than a melting point of the binding resin.

Accordingly, the toner can be softened (or melted) at 60 to 140 Celsius degrees, which is relatively lower temperature.

If the viscoelasticity rate is too small (such as less than 10 Pa) at a temperature of softening point (or melting point) or greater, the toner may more likely to offset at the heat roller (e.g., 47A, 48A), and by which the toner may be less likely to be transferred and fixed onto the transfer sheet P.

If the viscoelasticity rate is too large (e.g., 106 Pa), the toner may be less likely to be deformed when a pressure is applied to the toner, and by which the toner may be less likely to be transferred and fixed onto the transfer sheet P.

Furthermore, the mixing ratio of colorant with respect to the binding resin is preferably set from 1 to 30 wt % with following reason.

If the amount of colorant is too small with respect to the binding resin (e.g., less than 1 wt %), the viscosity of toner may become too low, and the image density may become smaller.

If the amount of colorant is too large with respect to the binding resin (e.g., greater than 30 wt %), the viscosity of toner may become too high, and the adhesiveness of toner to the transfer sheet P becomes too low when the toner is fixed at a relatively low temperature, by which a cold offset may more likely to occur.

Therefore, the mixing ratio of colorant with respect to the binding resin is preferably set from 1 to 30 wt % to balance the image density quality and fixability of toner.

The above-mentioned condition (b) is recommend for following reason.

If the weight average particle diameter of toner is too small (e.g., less than 3 □m) and such toner is used with carriers as two-component developer, toners may adhere on a surface of carriers with an effect of agitation of toners and carriers with a longer period of time in a developing unit, by which chargeability of carriers may degrade.

If the weight average particle diameter of toner is too small (e.g., less than 3 μm) and such toner is used as one-component developer, toners may more likely be filmed on a developing roller and be more likely to become adhered on a component such as blade, wherein the blade regulates a toner thickness on a developing roller.

The toner preferably has the weight average particle diameter of 3 to 8 μm to reproduce an image in a higher resolution (e.g., reproducing tiny dot) such as 600 dpi (dot per inch) or greater.

If the weight average particle diameter of the toner is from 3 to 8 μm, dot reproducibility may be improved because such toner includes toner particles have an effectively smaller diameter.

Furthermore, the toners having the weight average particle diameter of 3 to 8 μm may increase a toner density in a toner image because such toners can densely exist in the toner image. In general, the smaller the particle diameter of toner, the greater the density of toner per unit area.

Such toner image has a good thermal conductivity, and thereby the toner can be easily softened (or melted) when conducting a transferring and fixing toner image. Accordingly, such toner can have an effective transferability.

Furthermore, because such toners having a good thermal conductivity can be softened (or melted) with a relatively smaller amount of heat, an energy saving can be improved for the image forming apparatus 10.

If the weight average particle diameter D4 becomes too small (e.g., less than 3 μm), the transferability of toner and cleaning-ability of toner by a cleaning blade may become degraded.

If the weight average particle diameter D4 becomes too large (e.g., greater than 8 μm), toner images (e.g., letter, line) may be more likely to scatter.

The above-mentioned condition (c) is recommend for following reason.

A ratio D4/D1 is a ratio of the weight average particle diameter D4 with respect to the number average particle diameter D1.

The toner having a ratio D4/D1 of 1.00 to 1.40 has following favorable aspects.

In general, toner particles having a particle diameter matched to a pattern of electrostatic latent image are preferentially used to develop an electrostatic latent image compared to other toner particles not matched to the pattern of electrostatic latent image. Such phenomenon may be used to effectively produce a various types of image patterns.

If an image forming apparatus employs a recycling configuration to recover toners remaining on an image carrying member (e.g., photosensitive member) and to reuse such recovered toners, toner particles having a relatively smaller size are more likely to be recovered by recycling because smaller toner particles are less likely to be used for image forming.

If toner particles having a relatively larger diameter distribution are used and recycled, the diameter distribution of toner particles may change significantly when toner particles are consumed for image forming over the time. For example, when image forming operations are conducted, smaller toner particles are more likely to remain in a developing unit as above-explained. If fresh toner particles are supplied in such developing unit and image forming operations and toner recycling are conducted for a longer time, the ratio of smaller toner particles in the developing unit becomes higher, by which the diameter distribution of toner particles in the developing unit shifts to a smaller particle size over time because larger toner particles are more likely to be consumed for image forming. If diameter distribution of toner particles in the developing unit changes significantly, developability of toners may deteriorate.

Therefore, toners having a narrower particle diameter distribution is preferably used in the image forming apparatus 10.

The diameter (e.g., weight average particle diameter and number average particle diameter) distribution of toner particles can be measured with a measurement device using the Coulter Principle. For example, the diameter distribution of the toner particles may be measured with COULTER COUNTER TA-II or COULTER Multisizer II (manufactured by Beckman Coulter, Inc.).

Each sample can be prepared as below for measurement of the diameter distribution of toner particles.

At first, an electrolytic solution including purified water of 100 to 150 ml and first grade NaCl is prepared as approximately 1% NaCl solution (sodium solution), and such 1% NaCl solution is poured in a vessel. Isoton® II (a balanced electrolytic solution manufactured by Beckman Coulter, Inc.) can used as electrolytic solution, for example.

Then, 0.1 to 0.5 ml of surfactant (preferably alkylbenzene sulfonic acid salt) is added to the electrolytic solution as dispersing agent. Subsequently then, a sample of 2 to 20 mg is added to the solution. The mixed solution is dispersed for one to three minutes by an ultrasonic dispersion apparatus. Then the weight distribution and numbers distribution are computed by measuring weight and numbers of toner particles using an aperture of 100 μm.

The weight average particle diameter D4 and the number average particle diameter D1 can be obtained from weight distribution and numbers distribution of toner particles.

The measurement can be conducted with thirteen channels: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm.

The measurement is conducted for toner particles having a particle diameter of 2.00 μm to less than 40.30 μm.

The above-mentioned conditions (d) and (e) are recommend for following reason.

The shape factors SF-1 and SF-2 are parameters for expressing shape of toner, which are widely used in a field of powder technology.

Figure 9:
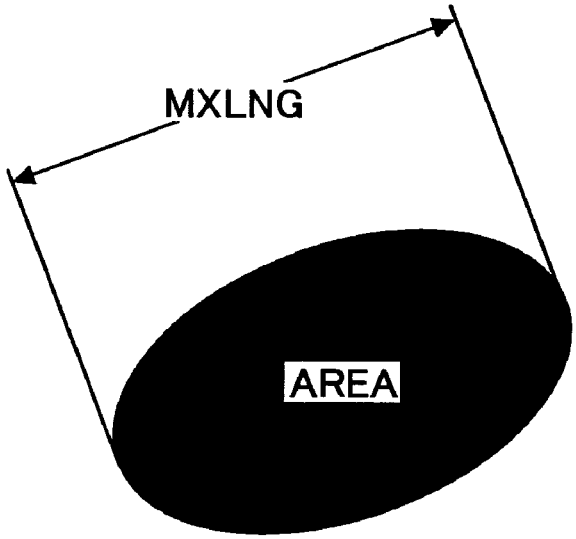
FIG. 9 is a schematic view for explaining a shape factor SF-1 of toner particle.

As illustrated in FIG. 9, the first shape factor SF-1 represents the degree of the roundness of toner particle and is defined by the following equation (1):

$$SF\text{-}1=\{(MXLNG)^2/(\mathrm{AREA})\}\times(100\pi/4) \quad (1)$$

wherein MXLNG represents a diameter of the circle circumscribing the image of a toner particle, which an image is obtained by observing the toner particle with a microscope; and AREA represents the area of the image.

When the first shape factor SF-1 is 100, the toner particle has a true spherical form. In this case, toner particles may contact the other toner particles and an image carrying member at one point. Therefore, the adhesion of the toner particles to the other toner particles or the image carrying member decreases, resulting in an increase of the fluidity of the toner particles and the transferability of the toner.

When the first shape factor SF-1 is too large, the toner particles have irregular forms, and thereby the toner has poor developability and poor transferability.

Figure 10:
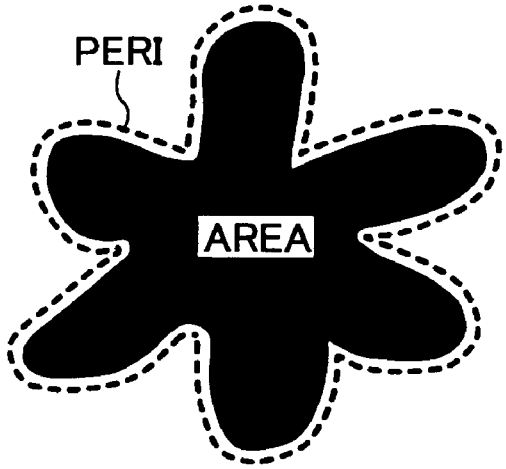
FIG. 10 is a schematic view for explaining a shape factor SF-2.

As illustrated in FIG. 10, the second shape factor SF-2 represents the degree of the concavity and convexity of a toner particle, and is defined by the following equation (2):

$$SF\text{-}2=\{(PERI)^2/(\mathrm{AREA})\}\times(100/4\pi) \quad (2)$$

wherein PERI represents the peripheral length of the image of a toner particle observed by a microscope; and AREA represents the area of the image.

When the second shape factor SF-2 approaches 100, the toner particles have a smoother surface (i.e., the toner has few concavity and convexity).

It is preferable for a toner to have a slightly roughened surface to obtain good clean-ability of the toner.

However, when the second shape factor SF-2 is too large (i.e., the toner particles are seriously roughened), a toner scattering (i.e., toner particles are scattered around a toner image) may occur, which results in a deterioration of the toner image qualities.

When the shape factors SF-1 and SF-2 become closer and closer to 100, the toner particle has a substantially true spherical form. In this case, the toner particles may contact other toner particles and an image carrying member at one point.

Therefore, adhesion of the toner particles to the other toner particles and the image carrying member decreases, resulting in an increase in the fluidity of the toner particles and the transferability of the toner because such toners may be have less adhesion to other objects such as toner and image carrying member and are more likely to be affected by a transfer electric field.

For example, toners may adhere to the heat roller with a smaller degree of adhesiveness, by which toner separation property of the heat roller may be improved and the toners may be effectively transferred from the heat roller (e.g., 47A, 48A) to the transfer sheet P, and thereby a toner offset may be suppressed.

Furthermore, when the shape factors SF-1 or SF-2 become too large (e.g., 180 or greater), the toner particles have irregular forms, and thereby the toner has poor transferability.

Accordingly, in an example embodiment, the first shape factor SF-1 is preferably set to 100 to 180, and the second shape factor SF-2 is preferably set to 100 to 180 for maintaining a good transferability of tone particles.

Furthermore, toner particles having a true spherical form may increase a toner density in a toner image because such toner particles can densely exist in the toner image.

Such toner image has a good thermal conductivity, and thereby the toners can be easily softened (or melted) when conducting a transferring and fixing of the toner image. Accordingly, such toner can have an effective transferability.

Furthermore, because such toners having good thermal conductivity can be softened (or melted) with a relatively smaller amount of heat, the energy savings can be improved for the image forming apparatus 10.

The above-mentioned condition (f) is recommend for following reason.

If fine particles are added on a surface of toner particle, one toner particle may contact another toner particle or image carrying member by interposing such fine particles therebetween when contacting each other, by which a buffer space can be set between objects (e.g., toner particle to toner particle, toner particle to image carrying member).

If surfaces of the toner particles contact with each other directly, such toner particles may stick with each other, by which the toner particles may not freely move.

Accordingly, the fine particles are preferably added on a surface of toner particles to secure some space between the toner particles.

Such fine particles may contact to toner particles, a photoconductive member, an intermediate transfer belt (e.g., 21, 31), and a heat roller (e.g., 47A, 48A) with a smaller contact area.

Accordingly, the degree of adhesion of toners to other objects can be made smaller, by which developability and transferability of toners can be efficiently improved, and the reproducibility of dot pattern can be improved.

Furthermore, the fine particles may function as a buffer particle, wherein such buffer particle may reduce friction between toner particles and a photoconductive member, which is favorable from the viewpoint of reducing stresses to the photoconductive member. Accordingly, abrasion or damage to the photoconductive member may be reduced.

The fine particles may not submerge in a toner particle even when a higher stress (e.g., higher pressure) is applied for cleaning the photoconductive member with a cleaning blade.

Because the fine particles are relatively hard particles, such fine particles may submerge in a toner particle, by which the fine particles may not exert its function. Therefore, an adhesion of fine particles to toner particles is controlled so that the fine particles may not be submerged in the toner particles, by which a toner property can be maintained at a stable level for a longer period of time.

Furthermore, the fine particles, which may drop off from the surface of the toner particle, may adhere and accumulate on an edge on the cleaning blade because the fine particles are smaller in size and stronger in terms of adhesion as compared to toner particles, wherein such accumulation is referred as "dam effect". With such "dam effect," the cleaning blade can effectively collect toner particles.

Such property of fine particles can reduce a stress to be applied to toner particles, by which toner particles may not be subjected to friction with the photosensitive member. Therefore, a filming, which may be caused by a low rheology component (e.g., lower molecular weight resin) included in toners, can be reduced when a high speed fixing is conducted.

The fine particles preferably have a smaller particle diameter from 50 to 500 nm for average primary particle diameter, wherein the average primary particle diameter is an average diameter of particles when particles are not aggregated.

If such fine particles having a smaller average primary particle is used, a good cleaning-ability and good fluidity of toner may be obtained.

Furthermore, even if the fine particles contaminate the carriers (e.g., fine particles may stick on a surface of the carriers), such phenomenon may not seriously affect the developability of toners when the above-mentioned fine particles are used as additives for toner particles.

Accordingly, the fluidity of toner and chargeability of carriers may not be changed significantly over the time when such fine particles are used, by which a higher image quality may be obtained over the time.

The fine particles have an average primary particle diameter of 50 to 500 nm, and preferably 100 to 400 nm.

If the average particle diameter of the fine particles is too small (e.g., less than 50 nm), the fine particles may drop into concave portions on a toner surface, by which fine particles may not be exposed from the toner surface. If the fine particles drop into concave portions, such fine particles may not effectively function as buffer particles.

If the average particle diameter of the fine particle is too large (e.g., greater than 500 nm), the cleaning ability of the toners on a surface of the photoconductive member may be degraded as explained below.

Specifically, if such fine particles having a larger diameter exist between a surface of a photoconductive member and a cleaning blade, toner particles may not be removed by the cleaning blade because such fine particles may have a contact area, which is similar to the toner particle, and such condition may lead to a passing off the toner particle at the cleaning blade. Accordingly, a cleaning-ability of toners may degrade.

If the bulk density of the fine particles is too small (e.g., less than 0.3 mg/cm$^3$), toner particles and fine particle may unfavorably spatter and adhere, by which the fine particles may degrade its functions such as buffer particle and dam effect for clean-ability toner, although such fine particles may improve fluidity of tone particles somewhat The fine particles include inorganic compounds and organic compounds.

The inorganic compounds includes $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrrO_2$, $CaO.SiO_2$, $K_2O(TiO_2)_n$, $Al_2O_3.2SiO_2$, $CaCO_3$, $MgCO_3$, $BaSO_4$, $MgSO_4$, and $SrTiO_3$, and preferably includes $SiO_2$, $TiO_2$, $Al_2O_3$, and more preferably $SiO_2$.

These inorganic compounds may be treated by coupling agents, hexamethyldisilazane, dimethyldichlorosilane, and octyl-trimethoxysilane, for example, to add hydrophobic property to inorganic compounds.

The organic compounds include thermoplastic and thermosetting resin such as vinyl resin, polyurethane resin, epoxy resin, polyester resin, polyamide resin, polyimide resin, silicone resin, phenolic resin, melamine resin, urea resin, aniline resin, ionomer resin, polycarbonate resin, etc. These resins can be used alone or in combination.

Suitable resins for use as the fine particles include known resins, which can form an aqueous dispersion. Among these resins, vinyl resin, polyurethane resin, epoxy resin, and polyester resin are preferably used because an aqueous dispersion including fine spherical resin particles can be easily prepared. These resins can be used alone or in combination.

Specific examples of the vinyl resin include homopolymers or copolymers obtained from one or more vinyl monomers such as styrene-(meth)acrylate ester copolymers, styrene-butadiene copolymers, (meth)acrylic acid-acrylate ester copolymers, styrene-acrylonitrile copolymers, styrene-maleic anhydride copolymers, and styrene-(meth)acrylic acid copolymers, etc.

The bulk density of the fine particles is defined by the following equation (3):

$$\text{Bulk density (g/cm}^3\text{)}=[\text{fine particle amount (g)}/100\ \text{ml}]/100 \quad (3)$$

The amount of fine particles can be measured as below. Fine particles of 100 ml are poured into a 100 ml-graduated cylinder without giving vibration to the graduated cylinder. The weight difference before and after pouring fine particles in the graduated cylinder is measured as amount of fine particles.

The fine particles can be added and adhered on the toner surface by a method such as mixing toner particles and fine particles with a mixing machine, or dispersing toner particles and fine particles uniformly in a liquid with a surfactant and drying the resultant particles.

Hereinafter, Examples and Comparative Examples for the present disclosure are explained in detail.

Example 1

Example 1 uses an intermediate transfer belt and a surface layer of heat roller, made by following materials and conditions.

Materials:

Polyimide resin varnish (Rikacoat PN-20, available from New Japan Chemical Co., Ltd.): 9.0 parts by weight (wt %);

Silicone-graft polyimide (i.e., acrylic vinylsilicone-maleimide copolymer, LBI-101-1 available from Soken Chemical & Engineering Co., Ltd.): 1.0 part by weight (wt %);

N,N-Dimethylacetamide (solvent): 90.0 parts by weight (wt %).

A liquid prepared from the above materials was poured into an inside portion of an cylinder-shaped tool, and the cylinder shaped tool was rotated at a high speed to uniformly form a film made from such liquid, and dried at 170 Celsius degree for 8 hours to obtain a seamless film. The resultant film was inserted onto an outer face of another cylinder-shaped tool and baked at 300 Celsius degree for 2 hours.

As a result, a mixture film having a 60 μm thickness comprising polyimide and silicone resin-graft polyimide was formed and used as intermediate transfer belt.

Then, a core of roller was coated with Teflon (registered trademark) rubber having a thickness of 200 μm and was coated with silicone-graft polyimide by spraying the above-mentioned liquid. Thereafter, it was dried at 180 Celsius degree for 8 hours, and then the coated film was baked at 300 Celsius degree for 2 hours.

The resulting intermediate transfer belt and heat roller were integrated into the double-face transfer unit in FIG. 4, and were subjected to a durability test at a temperature of 185 Celsius degree set for the first and second transfix units 47 and 48.

The target number of sheets in this durability test was 500,000 sheets.

After the durability test of 700,000 sheets, no irregular images such as off-set occurred, a winding of intermediate transfer belt to the heat roller was not observed, and a sheet separation problem such as sticking of transfer sheet to the heat roller was not observed, and the resulting image at the time of 700,000 sheets had nearly a same quality as image obtained at initial stage, which is an earlier period of time of durability test.

After the durability test of 700,000 sheets, it was observed that the surface of the intermediate transfer belt was little worn and that the luster of a portion on the surface, where a separation claw came in contact with, did not change substantially.

When the durability test was conducted over 700,000 sheets, it was observed that the separation claw was somewhat worn, that the luster of the heat roller surface changed to some extent, and it was observed by detail observation that the resulting image has some change in luster of a portion of the image where the separation claw came in contact with. However, such phenomenon did not affect the image quality of the resulting image.

Example 2

Example 2 uses an intermediate transfer belt and a surface layer of the heat roller, made by following materials and conditions.

Materials:

Polybenzimidazole (available from Clariant Co., Ltd.): 9.0 parts by weight (wt %);

Silicone-graft polyimide (i.e., acrylic vinylsilicone-maleimide copolymer, LBI-101-1 available from Soken Chemical & Engineering Co., Ltd.): 1.0 part by weight (wt %);

N,N-Dimethylacetamide (solvent): 90.0 parts by weight (wt %).

A liquid prepared from the above materials was poured into an inside portion of an cylinder-shaped tool, and the cylinder shaped tool was rotated at a high speed to uniformly form a film made from such liquid, and dried at 170 Celsius degree for 8 hours to obtain a seamless film. The resultant film was inserted onto an outer face of another cylinder-shaped tool and baked at 300 Celsius degree for 2 hours.

As a result, a mixture film having a 40 □m thickness comprising polyimide and silicone resin-graft polyimide was formed and used as intermediate transfer belt.

A heat roller prepared in Example 1 was used in Example 2.

The resulting intermediate transfer belt and the heat roller prepared in Example 2 were integrated into the double-face transfer unit shown in FIG. 5, and were subjected to a durability test at a temperature of 185 Celsius degree set for the first and second transfix unit.

A surface roughness and toner separateability of the intermediate transfer belt and the heat roller was controlled by an amount of magnetic substance, which was included in a coating agent for a surface layer of the intermediate transfer belt and the heat roller.

The intermediate transfer belt was set with a surface roughness of 2 to 3 μm, and set at a contact angle of 110 degrees. The heat roller was set with a surface roughness of 5 to 8 μm, and a contact angle of 95 degrees.

The target number of sheets in this durability test was 500,000 sheets.

After the durability test of 800,000 sheets, no irregular images such as off-set occurred, a winding of the intermediate transfer belt to the heat roller was not observed, and the resulting image at the time of 800,000 sheets had nearly a same quality as image obtained at initial stage, which is an earlier period of time of durability test.

After the durability test of 800,000 sheets, it was observed that the surface of the heat roller was little worn.

Comparative Example 1

In Comparative Example 1, an intermediate transfer belt was prepared with a polyimide layer coated with PFA (perfluoro alkoxyl) resin, and a heat roller was prepared by coating PFA (perfluoro alkoxyl) resin on a Teflon (registered trademark) rubber.

The resulting intermediate transfer belt and the heat roller prepared in Comparative Example 1 were integrated into the double-face transfer unit an shown in FIG. 5, and were subjected to a durability test at a temperature of 185 degrees Celsius set for the first and second transfix unit.

After a durability test of 100,000 sheets, it was observed that PFA layer of the intermediate transfer belt and heat roller was worn. For example, the surface layer of the heat roller was chipped away by the separation claw, and Teflon (registered trademark) rubber was exposed at such chipped area of the heat roller, and the toner adhered around such chipped area. Furthermore, it was observed that some of the surface layer of the heat roller, which did not contact of with the separation claw, was also chipped away. In addition, it was observed that a resulting image included black spots on its image, wherein such black spots may be aggregated toners caused by a tiny scale off-set phenomenon.

Example 3

A toner resin made by following materials was used in Example 3.

Materials:

Cyclized isoprene: 75 parts by weight (wt %);

Carnauba wax: 25 parts by weight (wt %);

Carbon black: 10 parts by weight (wt %) added as colorant.

Furthermore, a magnetic substance of 50 parts by weight (wt %) was also added to the toner particle. The resultant toner had a softening point of 82 degrees Celsius, and a minimum fixing temperature of 86 degrees Celsius. Such toner had a viscoelasticity rate of 1×104 c-poise at 110 degrees Celsius.

A coefficient of viscoelasticity rate of toner was measured without adding magnetic substance to the toner. A sample toner was sandwiched between parallel plates, and the dynamic viscoelasticity rate of the toner was measured by pressing the sample with the parallel plates (e.g., giving strain).

The toner had a weight average particle diameter D4 of 5 μm, and a ratio of D4/D1 of 1.30, and additives having a average primary diameter of 70 nm were added to the toner.

The resulting toner was used to conduct an image forming operation in the image forming apparatus 10 while the intermediate transfer belt and the heat roller prepared in Example 1 were integrated into the double-face transfer unit shown in FIG. 7.

A durability test was conducted under a condition having a line speed of 500 mm/sec and a transfer and fixing temperature of 150 degrees Celsius.

After the durability test of 500,000 sheets, no irregular images such as off-set during the transfix operation occurred, and image quality was confirmed to be good enough in terms of image density of solid image, resolution of thin line, and amount of dust on the image.

After a durability test of 500,000 sheets, the resulting image had nearly a same quality as image obtained at initial stage, which is an earlier period of time of durability test.

Furthermore, the toner of Example 3 did not cause a toner blocking phenomenon in a developing unit, and it was confirmed that such toner had a higher durability, and did not cause the toner off-set. Similar result was confirmed when a color colorant was used.

In the above-described example embodiments, the image forming apparatus 10 includes a transfix unit for the double-face transfer unit 50 to transfer and fix a toner image on a transfer sheet with heat and pressure at a transfer/fixing nip.

Accordingly, a fixing unit is not required in a transporting direction of transfer sheet after the transfer sheet is ejected out of the double-face transfer unit.

As a result, the transfer sheet having a toner image thereon is not transported from the double-face transfer unit 50 to the fixing unit, by which the toner image on the transfer sheet may not be disturbed.

Furthermore, a toner image is transferred from the intermediate transfer belt to the heat roller with a heat and transfer method instead of electrostatic transfer method. With such configuration, the toner image may not be affected by electric discharge or electric field at an entrance and exit of a transfer nip defined by the intermediate transfer belt and the heat roller, by which dust generation or bleeding of image can be prevented and a higher quality image can be obtained.

Furthermore, a toner image can be heated before transferring the toner image from the heat roller to the transfer sheet. Therefore, compared to a conventional method using a fixing unit, which heats a toner image and transfer sheet at the same time in the fixing unit, an amount of heat used for fixing a toner image on the transfer sheet can be reduced, by which an energy efficiency can be improved, and energy saving can be achieved.

Furthermore, after one toner image is transferred and fixed on the transfer sheet, the heat energy remaining on the heat roller can be used for transferring another toner image from the intermediate transfer belt to the heat roller.

With such configuration, a toner image can be transferred from the intermediate transfer belt to the heat roller directly, by which cost reduction and miniaturization of image forming apparatus 10 can be obtained.

Furthermore, the intermediate transfer belt can be made of material having a heat resistance and toner separation property, by which a deformation of the intermediate transfer belt by a heat generated on the heat roller can be suppressed.

Furthermore, because the intermediate transfer belt can include a toner separation property, a toner off-set such as adhesion of softened (or melted) toner to the intermediate transfer belt when transferring a toner image from the intermediate transfer belt to the heat roller can be suppressed. As a result, a heat and transfer method can be effectively conducted between the intermediate transfer belt and heat roller.

Furthermore, in the above-described example embodiments, the image forming apparatus 10 includes the heat roller having a surface layer made of material having a heat resistance and toner separation property, by which a deformation of the surface layer of the heat roller by a heat generated on the heat roller can be suppressed.

Furthermore, because the surface layer of the heat roller can include toner separation property, a toner off-set such as adhesion of softened (or melted) toner to the heat roller when transferring a toner image from the heat roller to the transfer sheet can be suppressed.

Furthermore, instead of the heat roller, a heat belt can also be used, and a temperature control of the heat roller and heat belt can be easily conducted. Furthermore, the layout in the image forming apparatus 10 can be changed more freely, and a relatively larger space can be allocated in the image forming apparatus 10 by selecting the heat roller or heat belt, as required.

Furthermore, the heat roller includes a magnetic substance, and is provided with a coil (e.g., magnetic field generator), which generates magnetic field around the heat roller. The heat roller can be heated by an electromagnetic induction effect of the magnetic field generated by the coil. With such configuration, the magnetic substance in the heat roller is effectively heated, and thereby the heat roller can be effectively heated.

Furthermore, the coil can heat the heat roller directly (or from the inside of the heat roller), which is different from heating the heat roller with a heat-radiant heating source (e.g., halogen lamp). Accordingly, the heat roller can be heated with a shorter period of time compared to using the heat-radiant heating source (e.g., halogen lamp). As a result, the waiting time required to heat up the heat roller to a given temperature when starting-up the image forming apparatus 10 can be shortened.

Furthermore, the surface layer of heat roller includes the magnetic substance, by which the surface layer of the heat roller can be effectively heated, and thus the heat roller can be heated up in a shorter period of time. Furthermore, the surface layer of the heat roller can be heated to a higher temperature by including the magnetic substance.

As a result, a toner image on the intermediate transfer belt can be softened (or melted) effectively by using a heat generated on the heat roller when to transfer the toner image from the intermediate transfer belt to the heat roller, and good transferability of toner image from the intermediate transfer belt to the heat roller can be obtained.

If the amount of magnetic substance in the surface layer of the heat roller is less than 30 wt %, the surface layer of the heat roller may not be effectively heated.

Furthermore, the surface layer of the heat roller has a volume resistivity of $10^9$ Ω·cm, for example, by which an electromagnetic induction current may more easily flow in the surface layer of the heat roller, by which the heating layer of the heat roller can be heated effectively. Accordingly, the heating efficiency and energy saving in the image forming apparatus 10 can be improved.

Furthermore, if the amount of magnetic substance included in the toner is 30 wt % or greater, the toner can heat up itself with an electromagnetic induction effect generated by the coil. With such configuration, the toner can be easily softened (or melted), and transferability and fix-ability of toners to the transfer sheet can be improved. If the amount of magnetic substance included in the toner is less than 30 wt %, the toner may not be heated effectively.

Furthermore, the surface layer of the heat roller and intermediate transfer belt are made of a material, which may not deform at 250 degrees Celsius. With such configuration, even if the heat roller is heated to a higher temperature to soften (or melt) toners, the surface layer of the heat roller and the intermediate transfer belt may not be deformed by heat.

Furthermore the surface layer of the heat roller and intermediate transfer belt are made of a material, which has a water contact angle of 90 degrees or greater. If the water contact angle is 90 degrees or greater, the surface energy of the surface layer of the heat roller and intermediate transfer belt may become smaller, and objects such as toner may less like to adhere on the surface layer of the heat roller and intermediate transfer belt. Accordingly, toners can be separated from the surface layer of the heat roller and intermediate transfer belt more easily, by which a toner off-set can be suppressed, and a good transferability of toner image can be obtained.

Furthermore, the surface layer of the heat roller and intermediate transfer belt has a surface roughness Rz of 10 μm or less as ten points average height (JIS B 0601-1994).

With such configuration, toner separatability from the surface of the heat roller and intermediate transfer belt can be improved, and the toner image can be effectively transferred to the transfer sheet.

Furthermore, because the heat roller is heated to a higher temperature as compared with the intermediate transfer belt, the heat roller is preferably made of material having a higher heat resistance, compared to the intermediate transfer belt, to improve heat resistance of the heat roller.

Furthermore, toners may be transferred from a higher toner separation material to a lower toner separation material when conducting a transfer operation with heat.

If the intermediate transfer belt has a toner separation property, which is larger than that of heat roller, toner transferability from the intermediate transfer belt to the heat roller can be improved.

The surface layer of the heat roller and the intermediate transfer belt can be made of a material such as heat resistance resin. Such heat resistance resin includes a principal chain such as a polyimide structure, a poly-benzimidazole structure, and a polyamide structure, and a side chain can be extended from the principal chain such as polysiloxane structure, for example.

With such configuration, the surface layer of the heat roller and the intermediate transfer belt can have heat resistance and a toner separation property.

Furthermore, a fluorinated resin or silicone resin can be coated on a surface of the heat resistance resin, wherein the heat resistance resin includes the principal such as a polyimide structure, a poly-benzimidazole structure, and a polyamide structure. By using such materials, the surface layer of the heat roller and intermediate transfer belt can have a heat resistance and toner separation property.

Furthermore, the toner for use in the image forming apparatus 10 can be softened (or melted) in a range of 60 to 140 degrees Celsius. Accordingly, the toner may not soften (or melt) at a room temperature, and the temperature of the heat roller can be suppressed to a lower temperature.

Furthermore, the viscoelasticity rate of the toner at a softening point (or melting point) or greater is set in a range of 10 to 106 Pa, by which the toner can be effectively deformed with a pressure, and the toner may be preferably transferred to a transfer-receiving face (e.g., transfer sheet) because such toner can be fit in concavities and convexities on the surface of the transfer-receiving face (e.g., transfer sheet).

Furthermore, because the colorant is included in a binding resin in a range of 1 to 30 wt %, the toner can maintain a good viscoelasticity rate when the toner is softened (or melted).

Furthermore, the binding resin is mixed with wax that can melt at a lower temperature. With such configuration, the softening point of toner can be lowered, and thereby the temperature of the heat roller for softening toner can be set to a lower temperature.

Furthermore, the ratio of (D4/D1) is set to a 1.00 to 1.40, wherein D4 is a weight average particle diameter having a 3 to 8 μm range and D1 is the number average particle diameter.

When a toner image is formed with such toner, a toner-to-toner microscopic space in the toner image can be made smaller. Accordingly, the toner density in the toner image can be increased, and thermal conductivity of toner-to-toner can be increased, by which toners can be easily softened (or melted) when conducting a transfer operation with heat. With such configuration, the transferability of toner can be increased.

Furthermore, because of such good thermal conductivity, the toners can be softened (or melted) with a smaller amount of heat, by which an energy saving of the image forming apparatus 10 can be obtained.

Furthermore, the toner for use in example embodiments has the first shape factor SF-1 from 100 to 180, and second shape factor SF-2 from 100 to 180, which is closer to a true spherical form. When a toner image is formed with such toner, the toner-to-toner microscopic spacing in a toner image can be made smaller. Accordingly, the toner density in the toner image can be increased, and thermal conductivity of toner-to-toner spacing can be increased, by which toners can be easily softened (or melted) when conducting a transfer operation with a heat effect. With such configuration, transferability of toner can be increased.

Because of such good thermal conductivity, toners can be softened (or melted) with a smaller amount of heat, by which an energy saving of the image forming apparatus 10 can be obtained.

Furthermore, the toner for use in example embodiments includes additives such as fine participles having an average primary particle diameter from 50 to 500 nm and a bulk density of 0.3 g/cm$^3$ or greater, by which adhesion of toners to other objects (e.g., intermediate transfer belt) can be reduced, and by which transferability of toner can be improved.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2005-207866 filed on Jul. 15, 2005 in the Japan Patent Office, the entire contents of which is hereby incorporated by reference herein.

The invention claimed is:

1. An image forming apparatus, comprising:

a first image carrying member configured to carry a first toner image, formed with a toner, on a surface of the first image carrying member, a first transfix unit, comprising:

a first heater; and a first heatable member, heated by the first heater, configured to receive the first toner image from the first image carrying member with heat generated on the first heatable member and configured to transfer and fix the first toner image onto a first face of a recording sheet with the heat generated on the first heatable member;

a second image carrying member configured to carry a second toner image, formed with a toner, on a surface of the second image carrying member;

a second transfix unit, comprising:

a second heater; and a second heatable member, heated by the second heater, configured to receive the second toner image from the second image carrying member with heat generated on the second heatable member and configured to transfer and fix the second toner image onto a second face of the recording sheet with the heat generated on the second heatable member surface layers of the first and second heatable members have a heat resistance which is greater than a heat resistance of the first and second image carrying members, and the first and second image carrying members have a toner separation property which is greater than a toner separation property of the surface layers of the first and second heatable members.

2. The image forming apparatus according to claim 1, wherein the first and second heaters include a magnetic field generator configured to generate a magnetic field around the first and second heatable members.

3. The image forming apparatus according to claim 2, wherein the first and second heatable members further include a heating layer having a magnetic substance therein at a concentration of 30% weight or greater, and the magnetic field generated by the magnetic field generator is used to heat the magnetic substance in the heating layer of the first and second heatable member members with an electromagnetic induction effect.

4. The image forming apparatus according to claim 3, wherein the surface layers of the first and second heatable members have a volume resistivity of $10^9$ Ω·cm.

5. The image forming apparatus according to claim 2, wherein the toner has a magnetic substance therein at a concentration of 30% weight or greater, and the magnetic field generated by the magnetic field generator is used to heat the magnetic substance in the toner with an electromagnetic induction effect.

6. The image forming apparatus according to claim 1, wherein the surface layers of the first and second heatable members and the first and second image carrying members include a material which suppresses a heat deformation at a temperature of 250 degrees Celsius and has a water contact angle of 90 degrees or greater, and the surface layers of the first and second heatable members and the first and second image carrying members have a surface roughness Rz of 10 μm or less at a ten points average height.

7. The image forming apparatus according to claim 1, wherein the surface layers of the first and second heatable members and the first and second image carrying members include a heat resistance resin, and the heat resistance resin includes a principal chain and a side chain extended from the principal chain, the principal chain includes any one of a polyimide structure, a poly-benzimidazole structure, and a polyamide structure, and the side chain includes a polysiloxane structure.

8. The image forming apparatus according to claim 1, wherein the surface layers of first and second the heatable members and the first and second image carrying members include a heat resistance resin coated with any one of fluorinated resin and silicone resin, and the heat resistance resin has a principal chain including any one of a polyimide structure, a poly-benzimidazole structure, and a polyamide structure.

* * * * *